US012391882B2

(12) United States Patent
Otterstrom

(10) Patent No.: US 12,391,882 B2
(45) Date of Patent: Aug. 19, 2025

(54) APPARATUS, SYSTEM, AND METHOD FOR SHALE PYROLYSIS

(71) Applicant: PYRO DYNAMICS LLC, Pleasant Grove, UT (US)

(72) Inventor: Gary G. Otterstrom, Lindon, UT (US)

(73) Assignee: PYRO DYNAMICS LLC, Pleasant Grove, UT (US)

( * ) Notice: Subject to any disclaimer, the term of this patent is extended or adjusted under 35 U.S.C. 154(b) by 0 days.

(21) Appl. No.: 18/408,382

(22) Filed: Jan. 9, 2024

(65) Prior Publication Data

US 2024/0309274 A1 Sep. 19, 2024

Related U.S. Application Data

(63) Continuation of application No. 17/900,776, filed on Aug. 31, 2022, now Pat. No. 11,866,649, which is a (Continued)

(51) Int. Cl.
*C10B 1/06* (2006.01)
*C10B 1/04* (2006.01)

(Continued)

(52) U.S. Cl.
CPC ..... *C10B 49/06* (2013.01); *C10B 1/04* (2013.01); *C10B 1/06* (2013.01); *C10B 1/08* (2013.01);

(Continued)

(58) Field of Classification Search
None
See application file for complete search history.

(56) References Cited

U.S. PATENT DOCUMENTS 1,443,742 A * 1/1923 Hess ..... C10G 7/00 208/365
1,568,157 A * 1/1926 Hess ..... C10G 7/00 203/25

(Continued)

FOREIGN PATENT DOCUMENTS

GB 487983 A 6/1938

OTHER PUBLICATIONS

PCT Application No. PCT/US2018/048614 filed Aug. 29, 2018, "International Search Report", mailed Feb. 7, 2019, pp. 1-7.

(Continued)

*Primary Examiner* — Jonathan Luke Pilcher
(74) *Attorney, Agent, or Firm* — Kunzler Bean & Adamson; Bruce R. Needham

(57) ABSTRACT

A shale pyrolysis system includes a retort with a first side and a second side. The second side is opposite the first side and the first side and the second side include descending angled surfaces at alternating angles to produce zig-zag motion of shale descending through the retort. Corners of the retort that change direction of the shale are rounded. The system includes steam distributors coupled to the first side and collectors coupled to the second side to produce cross-flow of steam and heat across the descending shale from the first side to the second side, and a steam temperature control subsystem coupled to the steam distributors and configured to deliver higher-temperature steam to one or more upper sections of the retort and lower-temperature steam to one or more lower sections of the retort.

20 Claims, 19 Drawing Sheets

Related U.S. Application Data continuation-in-part of application No. 17/466,628, filed on Sep. 3, 2021, now Pat. No. 11,834,612, which is a continuation of application No. 17/188,836, filed on Mar. 1, 2021, now Pat. No. 11,111,440.

(60) Provisional application No. 62/982,636, filed on Feb. 27, 2020.

(51) Int. Cl.

| | |
|---|---|
| ***C10B 1/08*** | (2006.01) |
| ***C10B 49/04*** | (2006.01) |
| ***C10B 49/06*** | (2006.01) |
| ***C10B 53/06*** | (2006.01) |
| ***C10G 1/02*** | (2006.01) |

(52) U.S. Cl.

CPC ..... *C10B 49/04* (2013.01); *C10B 53/06* (2013.01); *C10G 1/02* (2013.01)

(56) References Cited

U.S. PATENT DOCUMENTS

| | | | | |
|---|---|---|---|---|
| 1,598,217 | A | 8/1926 | Odell | |
| 1,608,741 | A * | 11/1926 | Hess | C10G 7/00 137/340 |
| 1,687,991 | A | 10/1928 | Parker | |
| 1,766,132 | A | 6/1930 | Kraul | |
| 1,800,366 | A | 4/1931 | Stewart | |
| 1,938,596 | A | 12/1933 | Karrick | |
| 1,967,691 | A | 7/1934 | Traut | |
| 2,448,223 | A * | 8/1948 | Lants | C10B 49/06 201/37 |
| 2,560,767 | A * | 7/1951 | Huff | C10G 1/02 201/37 |
| 2,752,292 | A | 6/1956 | Scott, Jr. | |
| 3,150,063 | A | 9/1964 | Comte | |
| 3,371,429 | A | 3/1968 | Miller et al. | |
| 3,377,266 | A | 4/1968 | Salnikov | |
| 3,384,569 | A | 5/1968 | Peet | |
| 3,801,469 | A | 4/1974 | Essenhigh | |
| 3,972,801 | A | 8/1976 | Gregoli | |
| 4,010,092 | A | 3/1977 | Deering | |
| 4,038,154 | A | 7/1977 | Barnebey | |
| 4,231,844 | A | 11/1980 | Weber et al. | |
| 4,464,247 | A | 8/1984 | Thacker | |
| 4,539,917 | A | 9/1985 | Mallon et al. | |
| 4,600,476 | A | 7/1986 | Edwards | |
| 4,601,811 | A | 7/1986 | Lewis et al. | |
| 4,619,738 | A | 10/1986 | Lewis et al. | |
| 4,880,528 | A | 11/1989 | Westhoff et al. | |
| 4,900,429 | A | 2/1990 | Richardson | |
| 5,531,800 | A | 7/1996 | Sewell et al. | |
| 7,293,511 | B2 | 11/2007 | Prigmore et al. | |
| 7,798,077 | B2 | 9/2010 | Gehring et al. | |
| 8,187,350 | B2 | 5/2012 | Firey | |
| 8,328,992 | B1 | 12/2012 | Swain | |
| 9,926,492 | B2 * | 3/2018 | Witherspoon | C10B 49/04 |
| 10,047,296 | B2 | 8/2018 | Wang | |
| 10,829,693 | B2 | 11/2020 | Otterstrom | |
| 11,111,440 | B1 * | 9/2021 | Otterstrom | C10B 1/04 |
| 11,834,612 | B2 * | 12/2023 | Otterstrom | C10B 49/04 |
| 11,866,649 | B2 * | 1/2024 | Otterstrom | C10B 1/08 |
| 2005/0194244 | A1 | 9/2005 | Merrell et al. | |
| 2008/0086945 | A1 * | 4/2008 | Wunning | C10J 3/482 48/197 R |
| 2008/0314726 | A1 | 12/2008 | Choros | |
| 2010/0293837 | A1 | 11/2010 | Firey | |
| 2010/0293847 | A1 | 11/2010 | Firey | |
| 2019/0062637 | A1 | 2/2019 | Otterstrom | |

OTHER PUBLICATIONS

PCT Application No. PCT/US2021/020338 filed Mar. 1, 2021, "Written Opinion of the International Searching Authority", mailed May 27, 2021, pp. 1-8.

U.S. Appl. No. 17/188,836, filed Mar. 1, 2021, Notice of Allowance mailed May 7, 2021.

U.S. Appl. No. 17/466,628, filed Sep. 3, 2021, Non-final Office Action May 13, 2022.

U.S. Appl. No. 17/466,628, filed Sep. 3, 2021, Final Office Action mailed Apr. 24, 2023.

U.S. Appl. No. 17/900,776, filed Aug. 31, 2022, Notice of Allowance mailed Aug. 29, 2023.

* cited by examiner

APPARATUS, SYSTEM, AND METHOD FOR SHALE PYROLYSIS

CROSS-REFERENCES TO RELATED APPLICATIONS

This is a continuation application of and claims priority to U.S. patent application Ser. No. 17/900,776 entitled "APPARATUS, SYSTEM, AND METHOD FOR SHALE PYROLYSIS" and filed on Aug. 31, 2022 for Gary G. Otterstrom, which claims priority to U.S. patent application Ser. No. 17/466,628 entitled "APPARATUS, SYSTEM, AND METHOD FOR SHALE PYROLYSIS" and filed on Sep. 3, 2021 for Gary G. Otterstrom, which claims priority to U.S. patent application Ser. No. 17/188,836 entitled "APPARATUS, SYSTEM, AND METHOD FOR SHALE PYROLYSIS" and filed on Mar. 1, 2021 for Gary G. Otterstrom, which claims the benefit of U.S. Provisional Patent Application No. 62/982,636 entitled "APPARATUS, SYSTEM, AND METHOD FOR SHALE PYROLYSIS" and filed on Feb. 27, 2020 for Gary G. Otterstrom, and which are incorporated herein by reference for all purposes.

FIELD

The subject matter disclosed herein relates to oil and gas production and more particularly relates to shale pyrolysis.

BACKGROUND

Oil and gas may be produced from oil shale by a process of pyrolysis. At suitably high temperatures, kerogen in the shale thermally decomposes, releasing gases and vapors that may be recovered as shale gas and shale oil. Although oil shale is abundant, shale oil production costs have, at times, been uncompetitive with economical sources of conventional crude oil. Shale oil production costs may include the cost of retorting equipment with limited throughput, pre-production costs (e.g., to meet shale particle size limits), energy costs, water costs, and the like.

SUMMARY

A shale pyrolysis system includes a retort with a first side and a second side. The second side is opposite the first side and the first side and the second side include descending angled surfaces at alternating angles to produce zig-zag motion of shale descending through the retort. Corners of the retort that change direction of the shale are rounded. The system includes steam distributors coupled to the first side and collectors coupled to the second side to produce crossflow of steam and heat across the descending shale from the first side to the second side, and a steam temperature control subsystem coupled to the steam distributors and configured to deliver higher-temperature steam to one or more upper sections of the retort and lower-temperature steam to one or more lower sections of the retort.

Another apparatus for shale pyrolysis includes a retort with a first side and a second side. The second side is opposite the first side and the first side and the second side include descending angled surfaces at alternating angles to produce zig-zag motion of shale descending through the retort. Corners of the retort that change direction of the shale are rounded. The apparatus includes hot gas distributors coupled to the first side and collectors coupled to the second side to produce crossflow of a hot gas across the descending shale from the first side to the second side.

A method of shale pyrolysis includes providing a retort with a first side and a second side. The second side opposite the first side and the first side and the second side include descending angled surfaces at alternating angles to produce zig-zag motion of shale descending through the retort. Corners of the retort that change direction of the shale are rounded. The method includes providing steam distributors coupled to the first side and collectors coupled to the second side to produce crossflow of steam and heat across the descending shale from the first side to the second side. The method includes providing a steam temperature control subsystem coupled to the steam distributors and configured to deliver higher-temperature steam to one or more upper sections of the retort and lower-temperature steam to one or more lower sections of the retort. The method includes filling the retort with shale, moving shale through the retort by continuously removing shale at a bottom of the retort and adding shale at a top, pyrolyzing the shale by using the steam temperature control subsystem and the steam distributors to deliver the higher-temperature steam to the one or more upper sections of the retort and the lower-temperature steam to the one or more lower sections of the retort, and removing shale pyrolysis gases and the steam via the collectors.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
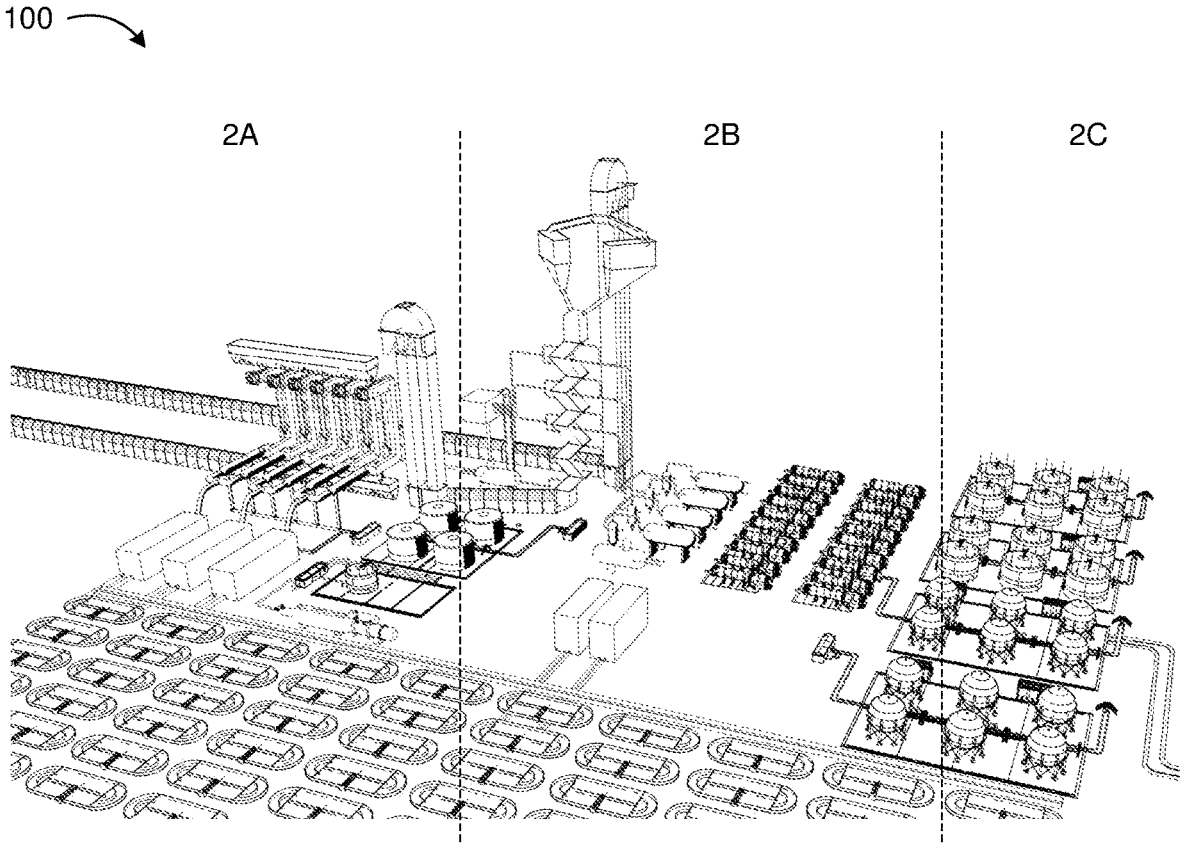
FIG. 1 is a perspective view illustrating a shale pyrolysis system, according to various embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

Aspects, components, or subsystems of one embodiment of a shale pyrolysis system are described herein. The described aspects, components, or subsystems may be used in combination as described herein, or may be used individually, or in subcombinations in other embodiments of shale pyrolysis systems, alongside other shale pyrolysis components or subsystems. For example, a retort and a distillation subsystem are described herein, but the retort may be used with a distillation column other than the described distillation subsystem, or the distillation subsystem may be used with a retort other than the described retort.

Apparatuses, systems, and methods are disclosed for shale pyrolysis. A system, in one embodiment, includes a retort, steam distributors and collectors, and a steam temperature control subsystem. A retort, in one embodiment, includes a first side and a second side opposite the first side. In a further embodiment, the first side and the second side include descending angled surfaces at alternating angles to produce zig-zag motion of shale descending through the retort. In one embodiment, steam distributors are coupled to the first side and collectors are coupled to the second side, to produce crossflow of steam and heat across the descending shale from the first side to the second side. A steam temperature control subsystem, in one embodiment, is coupled to the steam distributors and configured to deliver higher-temperature steam to an upper portion of the retort and lower-temperature steam to a lower portion of the retort.

In some embodiments, the steam temperature control subsystem includes one or more heaters for increasing steam temperature, and a plurality of steam/water mixers for reducing steam temperature to a plurality of different temperatures for delivery to different portions of the retort. In some embodiments, the plurality of steam/water mixers are configured to produce steam above 600° F. for distribution to a preheat section of the retort, steam above 750° F. for distribution to the upper portion of the retort, and steam below 300° F. for distribution to the lower portion of the retort.

The retort, in some embodiments, includes a preheat section for receiving and preheating shale entering the top of the retort. In some embodiments, the preheat section includes a plurality of preheat steam distributors disposed between the first side and the second side. In some embodiments, the preheat steam distributors include hollow vertical rods with side ports. The hollow vertical rods may extend downward from a grate with hollow members for receiving steam and distributing steam to the hollow vertical rods.

In some embodiments, a system includes a shale combustion subsystem, including one or more combustion chambers for combustion of pyrolyzed shale received from the retort, and one or more heat exchangers for superheating steam for the steam temperature control subsystem, using heat from the combustion of the pyrolyzed shale. In some embodiments, the shale combustion subsystem further includes one or more boilers for producing the steam. The one or more boilers may be configured to heat pressurized water and produce steam at one or more pressure release valves, and the shale combustion subsystem may include a pump for providing pressurized water to the boilers.

In some embodiments, one or more heat exchangers for superheating steam include vertical compartments for ascending steam to be heated by descending shale particles and combustion gases. In further embodiments, one or more boilers may include horizontal compartments for water to be heated by gases from which solids have been removed. In some embodiments, the shale combustion subsystem further includes one or more cyclonic separators disposed between the one or more heat exchangers for superheating steam and the one or more boilers, for removing the solids from the gases. In some embodiments, a system may include one or more filter houses, which may include iron-zinc filters for removing hydrogen sulfide from a horizontal flow of combustion gases, and a vertical flow of water for removing carbon dioxide from the combustion gases.

In some embodiments, a system may include a distillation subsystem, including a plurality of liquid/gas separation vessels that receive gases from the retort, and a plurality of organic Rankine cycle (ORC) generators corresponding to the separation vessels. In some embodiments, the ORC generators are coupled to and powered by heat exchangers of the separation vessels, and include different working fluids to produce different condensation temperatures for gases in different separation vessels. The separation vessels may be coupled in a chain so that gases exiting earlier separation vessels in the chain are received by later separation vessels in the chain. In some embodiments, the separation vessels may include four separation vessels for condensing hydrocarbons at different condensation temperatures, and a fifth separation vessel for condensing water.

An apparatus for shale pyrolysis, in one embodiment, includes a retort, and hot gas distributors and collectors. A retort, in one embodiment, includes a first side and a second side opposite the first side. In further embodiments, the first side and the second side include descending angled surfaces at alternating angles to produce zig-zag motion of shale descending through the retort. Hot gas distributors, in one embodiment, are coupled to the first side, and collectors are coupled to the second side, to produce crossflow of a hot gas across the descending shale from the first side to the second side.

In some embodiments, the hot gas is steam. In further embodiments, a steam temperature control subsystem may be coupled to the hot gas distributors and configured to deliver higher-temperature steam to an upper portion of the retort and lower-temperature steam to a lower portion of the retort.

A method for shale pyrolysis, in one embodiment, includes providing a retort including a first side and a second side opposite the first side. The first side and the second side may include descending angled surfaces at alternating angles to produce zig-zag motion of shale descending through the retort. In a further embodiment, the method includes providing steam distributors coupled to the first side and collectors coupled to the second side to produce crossflow of steam and heat across the descending shale from the first side to the second side. In a further embodiment, the method includes providing a steam temperature control subsystem coupled to the steam distributors and configured to deliver higher-temperature steam to an upper portion of the retort and lower-temperature steam to a lower portion of the retort. In a further embodiment, the method includes filling the retort with shale, and moving shale through the retort by continuously removing shale at the bottom of the retort and adding shale at the top. In a further embodiment, the method includes pyrolyzing the shale by using the steam temperature control subsystem and the steam distributors to deliver the higher-temperature steam to the upper portion of the retort and the lower-temperature steam to the lower portion of the retort. In a further embodiment, the method includes removing shale pyrolysis gases and the steam via the collectors.

In some embodiments, a method includes providing a preheat section of the retort, including a plurality of preheat steam distributors disposed between the first side and the second side. In further embodiments, a method includes delivering steam to the preheat section to preheat shale entering the top of the retort. In some embodiments, a method includes combusting pyrolyzed shale received from the retort to produce and superheat steam for the steam temperature control subsystem.

In some embodiments, a method includes providing a plurality of liquid/gas separation vessels coupled in a chain so that gases exiting earlier separation vessels in the chain are received by later separation vessels in the chain. In further embodiments, a method includes directing gases from the retort through the plurality of separation vessels to remove condensable hydrocarbons and water from the gases. In some embodiments, a method includes providing a plurality of organic Rankine cycle (ORC) generators coupled to and powered by heat exchangers of the separation vessels, where the ORC generators include different working fluids to produce different condensation temperatures for gases in different separation vessels. In further embodiments, a method includes removing different distillation cuts of condensed hydrocarbons, corresponding to the different condensation temperatures, from the separation vessels, and using the ORC generators to produce electricity using heat from condensing the hydrocarbons.

A shale pyrolysis system includes a retort with a first side and a second side. The second side is opposite the first side and the first side and the second side include descending angled surfaces at alternating angles to produce zig-zag motion of shale descending through the retort. Corners of the retort that change direction of the shale are rounded. The system includes steam distributors coupled to the first side and collectors coupled to the second side to produce crossflow of steam and heat across the descending shale from the first side to the second side, and a steam temperature control subsystem coupled to the steam distributors and configured to deliver higher-temperature steam to one or more upper sections of the retort and lower-temperature steam to one or more lower sections of the retort.

In some embodiments, each of the rounded corners of the retort has a radius sized such that a portion of shale descending through the retort maintains a same position relative to surrounding shale as the portion of shale passes through the retort and around a rounded corner. In other embodiments, each of the rounded corners has a radius between 1.5 feet and 4 feet. In other embodiments the steam temperature control subsystem includes one or more heaters for increasing steam temperature, and/or a plurality of steam/water mixers for reducing steam temperature to a plurality of different temperatures for delivery to different sections of the retort. In other embodiments, wherein the steam temperature control subsystem includes one or more temperature sensors on the second side of a section of the retort. The steam temperature control subsystem controls steam at distributors on the first side of the section with the one or more temperature sensors to maintain temperature at a temperature setpoint of the second side of the section of the retort.

In some embodiments, the collectors include horizontal slots. The horizontal slots are formed with overlapping plates with a gap in between the overlapping plates and the overlapping plates are arranged to allow gases from the retort to enter the gap while liquids running down the overlapping plates due to gravity bypass the gap. In other embodiments, the horizontal slots include a filter configured to prevent particles of shale from entering the gap while gases from the shale enter the gap. In other embodiments, the shale pyrolysis system includes a preheat section of the retort. The steam temperature control subsystem is configured to produce steam above 600° F. for distribution to the preheat section of the retort. In other embodiments, the preheat section for receiving and preheating shale entering a top of the retort includes a plurality of preheat steam distributors disposed between the first side and the second side. The preheat steam distributors include hollow vertical rods with side ports, the hollow vertical rods extending downward.

In some embodiments, the shale pyrolysis system includes a shale combustion subsystem. The shale combustion subsystem includes one or more combustion chambers for combustion of pyrolyzed shale received from the retort, and one or more heat exchangers for superheating steam for the steam temperature control subsystem, using heat from the combustion of the pyrolyzed shale. In other embodiments, the shale combustion subsystem one or more one or more boilers for producing the steam. In other embodiments, the shale pyrolysis system includes a distillation subsystem that includes a plurality of liquid/gas separation vessels that receive gases from the retort. In other embodiments, the shale pyrolysis system includes a plurality of organic Rankine cycle (ORC) generators corresponding to the separation vessels. The ORC generators are coupled to and powered by heat exchangers of the separation vessels, the ORC generators include different working fluids to produce different condensation temperatures for gases in different separation vessels, and the separation vessels are coupled in a chain such that gases exiting earlier separation vessels in the chain are received by later separation vessels in the chain. In other embodiments, the separation vessels include four separation vessels for condensing hydrocarbons at different condensation temperatures, and a fifth separation vessel for condensing water.

Another apparatus for shale pyrolysis includes a retort with a first side and a second side. The second side is opposite the first side and the first side and the second side include descending angled surfaces at alternating angles to produce zig-zag motion of shale descending through the retort. Corners of the retort that change direction of the shale are rounded. The apparatus includes hot gas distributors coupled to the first side and collectors coupled to the second side to produce crossflow of a hot gas across the descending shale from the first side to the second side.

In some embodiments, the hot gas is steam and the apparatus includes a steam temperature control subsystem coupled to the hot gas distributors and configured to deliver higher-temperature steam to an upper portion of the retort and lower-temperature steam to a lower portion of the retort.

A method of shale pyrolysis includes providing a retort with a first side and a second side. The second side opposite the first side and the first side and the second side include descending angled surfaces at alternating angles to produce zig-zag motion of shale descending through the retort. Corners of the retort that change direction of the shale are rounded. The method includes providing steam distributors coupled to the first side and collectors coupled to the second side to produce crossflow of steam and heat across the descending shale from the first side to the second side. The method includes providing a steam temperature control subsystem coupled to the steam distributors and configured to deliver higher-temperature steam to one or more upper sections of the retort and lower-temperature steam to one or more lower sections of the retort. The method includes filling the retort with shale, moving shale through the retort by continuously removing shale at a bottom of the retort and adding shale at a top, pyrolyzing the shale by using the steam temperature control subsystem and the steam distributors to deliver the higher-temperature steam to the one or more upper sections of the retort and the lower-temperature steam to the one or more lower sections of the retort, and removing shale pyrolysis gases and the steam via the collectors.

In some embodiments, the method includes providing a preheat section of the retort comprising a plurality of preheat steam distributors disposed between the first side and the second side and delivering steam to the preheat section to preheat shale entering the top of the retort. In other embodiments, the method includes providing a plurality of liquid/gas separation vessels coupled in a chain such that gases exiting earlier separation vessels in the chain are received by later separation vessels in the chain and directing gases from the retort through the plurality of separation vessels to remove condensable hydrocarbons and water from the gases. In other embodiments, the method includes measuring, using a temperature sensor, a temperature at the second side of a section of the retort, comparing the measured temperature with temperature setpoint, generating a control signal based on a difference between the measured temperature and the temperature setpoint, and adjusting steam at a distributor on the first side of the section of the retort using the control signal.

Figure 2A:
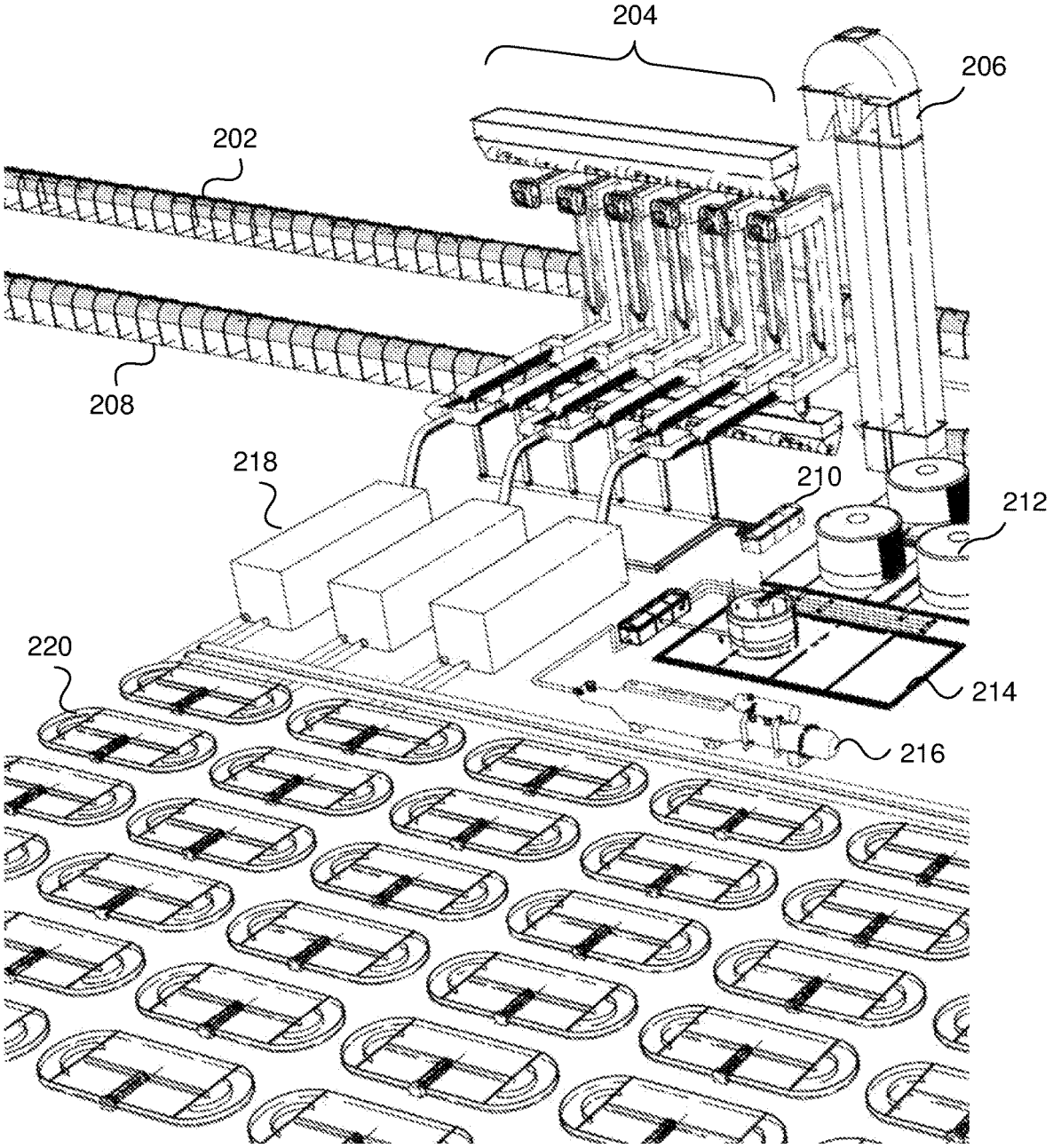
FIG. 2A is a partial view of the shale pyrolysis system of FIG. 1, according to various embodiments.
Figure 2B:
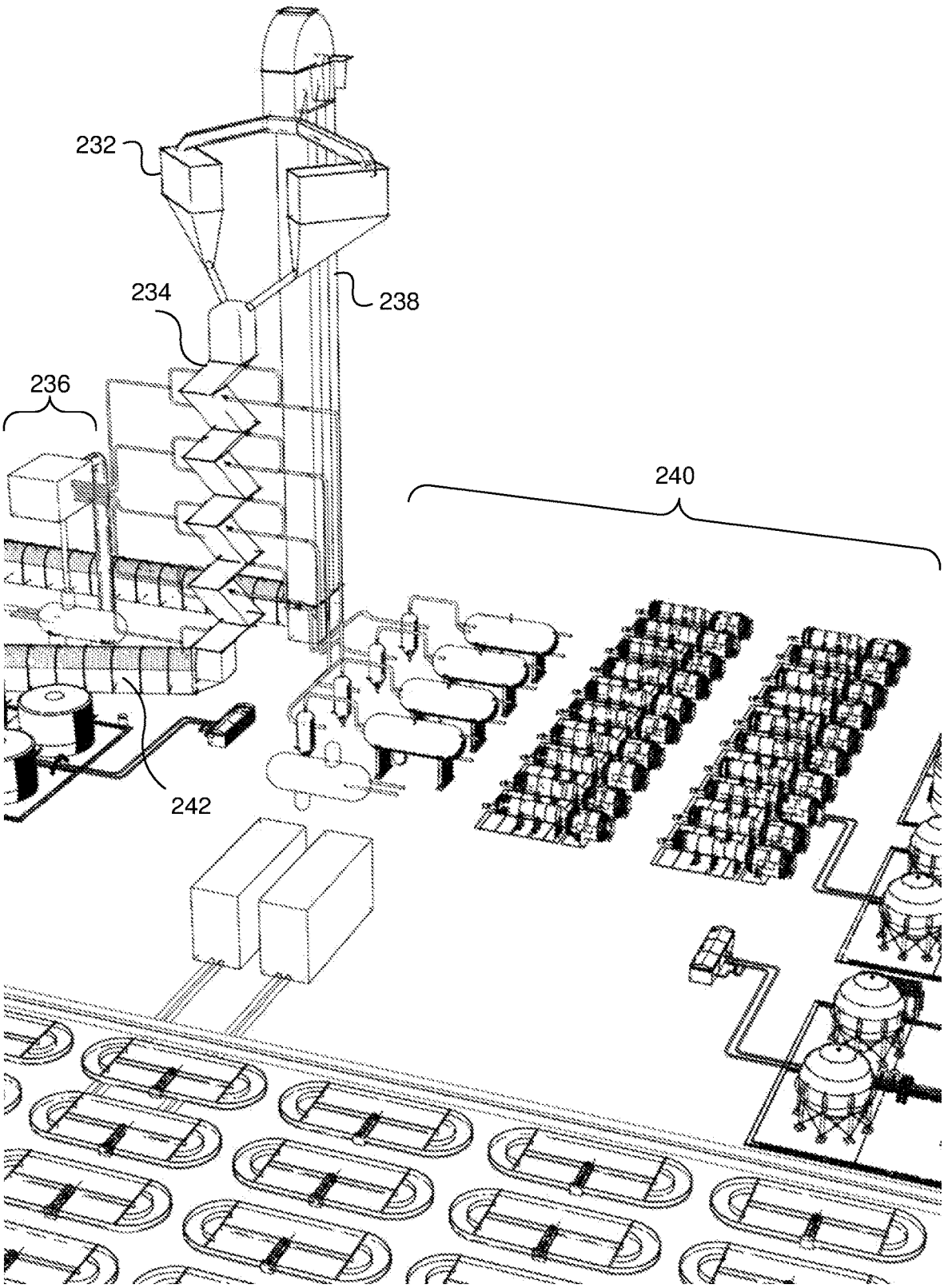
FIG. 2B is a partial view of the shale pyrolysis system of FIG. 1, according to various embodiments.
Figure 2C:
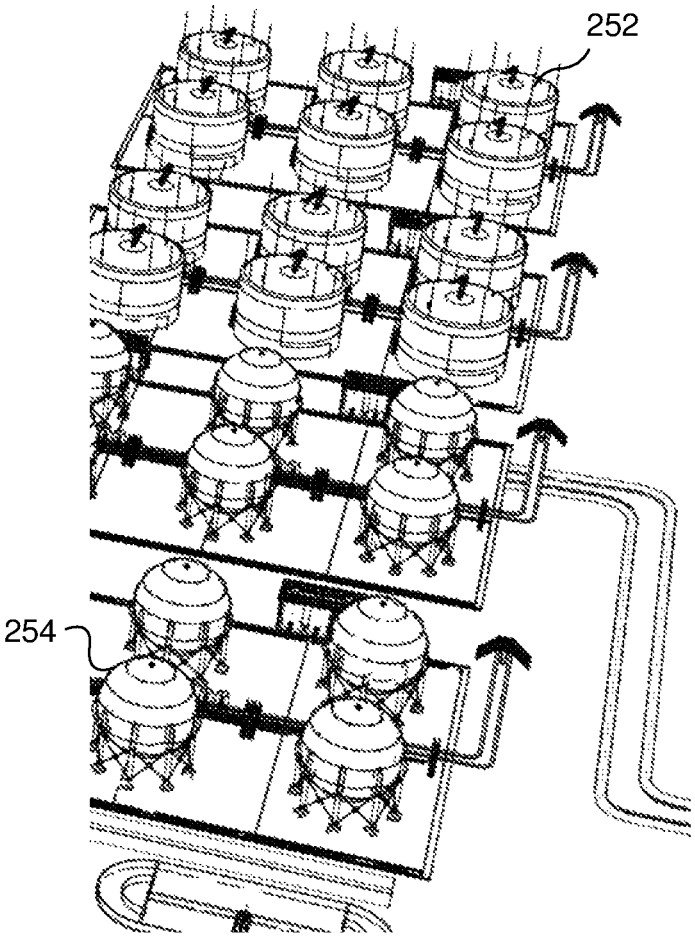
FIG. 2C is a partial view of the shale pyrolysis system of FIG. 1, according to various embodiments.

FIG. 1 is a perspective view illustrating one embodiment of a shale pyrolysis system 100. Partial views of the shale pyrolysis system 100 are depicted in FIGS. 2A, 2B, and 2C, while FIG. 1 is a smaller scale view showing the whole formed by the partial views, and indicating the positions of the partial views relative to the whole. Dashed lines in FIG. 1 indicate the edges of the partial views of FIGS. 2A, 2B, and 2C.

Referring to FIG. 2A, the depicted embodiment of a shale pyrolysis system 100 includes horizontal conveyors 202, 208, a shale combustion subsystem 204, a vertical conveyor 206, a pump 210, feedwater tanks 212, a sulfuric acid plant 214, a sulfuric acid storage tank 216, filter houses 218, and algae ponds 220. Referring to FIG. 2B, the depicted embodiment of a shale pyrolysis system 100 further includes hoppers 232, a retort 234, a steam temperature control subsystem 236, a vertical conveyor 238, a distillation subsystem 240, and a horizontal conveyor 242. Referring to FIG. 2C, the depicted embodiment of a shale pyrolysis system 100 includes liquid storage tanks 252 and gas storage tanks 254. Operation of the system 100 is first briefly described below with reference to FIGS. 2A, 2B, and 2C as a whole, and then individual components are described in further detail below with reference to subsequent Figures.

In the depicted embodiment, a horizontal conveyor 202 and a vertical conveyor 238 convey shale to one or more hoppers 232 above a retort 234. In general, in various embodiments, shale is heated in a retort 234 where pyrolysis occurs, releasing gases from thermal decomposition of kerogen in the shale. The gases include hydrocarbons which may be separated into different distillate cuts or fractions by a distillation subsystem 240. The gases may also include steam, which may similarly be condensed by the distillation subsystem 240. Liquid and gaseous products of the distillation subsystem 240 may be stored in liquid storage tanks 252 and gas storage tanks 254, respectively. Liquid storage tanks 252 store oil fractions produced by the distillation subsystem 240, while gas storage tanks 254 store non-condensed gases such as hydrogen, carbon dioxide, hydrogen sulfide and lighter hydrocarbons (e.g., methane through hexane).

In the depicted embodiment, the retort 234 includes opposite sides (to the left and to the right in FIG. 2B) with descending angled surfaces at alternating angles to produce zig-zag motion of shale descending through the retort 234. Thus, the retort 234 in the depicted embodiment is itself zig-zag shaped. Rounded corners of the zig-zag retort 234 facilitate shale moving in lanes without shale being trapped in corners, as explained in more detail in the retort 1200 of FIGS. 12A-12D and 13.

In the depicted embodiment, steam distributors are coupled to a first side of the retort 234 (to the left in FIG. 2B), and collectors are coupled to a second side opposite the first side (to the right in FIG. 2B), to produce a crossflow of steam and heat across the descending shale from the first side to the second side. In the depicted embodiment, the steam temperature control subsystem 236 is coupled to the steam distributors at the left of the retort 234, and is configured to deliver higher-temperature steam to an upper sections of the retort 234 and lower-temperature steam to a lower sections of the retort 234. In some embodiments, in the upper sections, steam temperatures increase between at least some of the sections with lower temperatures at the top of the upper sections and higher temperatures at the bottom of the upper sections. The flow of steam across the retort 234 heats and pyrolyzes the shale, so that steam and pyrolysis gases are removed from the retort 234 at the collectors on the second side of the retort 234. In various embodiments, a retort 234 as described herein may be capable of pyrolyzing a variety of types of shale with different minerology and different kerogen content.

In the depicted embodiment, the retort 234 is filled with shale, which is moved through the retort 234 from top to bottom, by removing shale at the bottom of the retort 234 and adding shale at the top. For example, shale may be moved from hoppers 232 into the top of the retort 234 by augers, and may similarly be moved from the bottom of the retort 234 to a horizontal conveyor 242 by augers, by conveyor, etc. The pyrolyzed shale removed from the retort 234 may include combustible material, such as various carbon compounds that were not vaporized in the retort 234 during pyrolysis. In the depicted embodiment, the horizontal conveyor 242 and the vertical conveyor 206 convey the pyrolyzed shale to a shale combustion subsystem 204, where the shale is combusted.

Shale may also include minerals that are not broken down by pyrolysis or consumed by combustion. Terms such as "shale pyrolysis" and "shale combustion" should be understood to refer to processes that affect portions of the shale, such as kerogen decomposing in the process of pyrolysis, and carbon solids reacting with oxygen in the process of combustion. Such terms do not imply that the entirety of the shale is either pyrolyzed or combusted.

In the depicted embodiment, a pump 210 pumps water from feedwater tanks 212 into the shale combustion subsystem 204, which uses heat from combustion of the pyrolyzed shale to boil the water (producing steam), and to superheat the resulting steam. In other embodiments, the boilers are heated by other methods, such as natural gas, electric heat, etc. and may be heated by a combination of sources. Boiling water and superheating the steam produces pressure to move the steam from the shale combustion subsystem 204 to the steam temperature control subsystem 236. The combusted shale cooled by heat transfer to the water/steam is removed from the system 100 by horizontal conveyor 208. Gases from shale combustion, also cooled by heat transfer to the water/steam are processed through filter houses 218 to remove hydrogen sulfide and carbon dioxide. In some embodiments, the hydrogen sulfide may be converted to sulfuric acid at a sulfuric acid plant 214 and stored in a sulfuric acid storage tank 216. In some embodiments, carbon dioxide may be dissolved into water, and the resulting carbon enriched water may be provided to one or more algae ponds 220. Algae in ponds 220 may process carbon dioxide by photosynthesis to produce algae oil. Thus, in various embodiments, outputs of the system 100 may include hydrocarbons from pyrolysis, sulfuric acid, and/or algae oil.

Various steps or components described herein as interrelated can be run semi-independently for a period of time (e.g., the system 100 as a whole may continue operating if an individual component or subsystem is offline for maintenance). For example, the steam temperature control subsystem 236 may temper superheated steam from the shale combustion subsystem 204, or may produce steam or add heat to steam if the shale combustion subsystem 204 is not producing steam at a desired temperature. Shale in the retort 234 may have a large thermal mass, allowing some extra heat to be added to or removed from the retort as needed. In some embodiments, electrical generators in the distillation subsystem 240 are operated across a wide temperature range without needing extensive human supervision for temperature changes. In other embodiments, water is buffered in the feedwater tanks 212 allowing steam to be produced as needed. Thus, various subsystems or components that depend on each other include buffers for energy or material, allowing the system 100 as a whole to be started up, maintained, or operated across a variety of working conditions without requiring a large degree of coordination between the components and subsystems.

Figure 3:
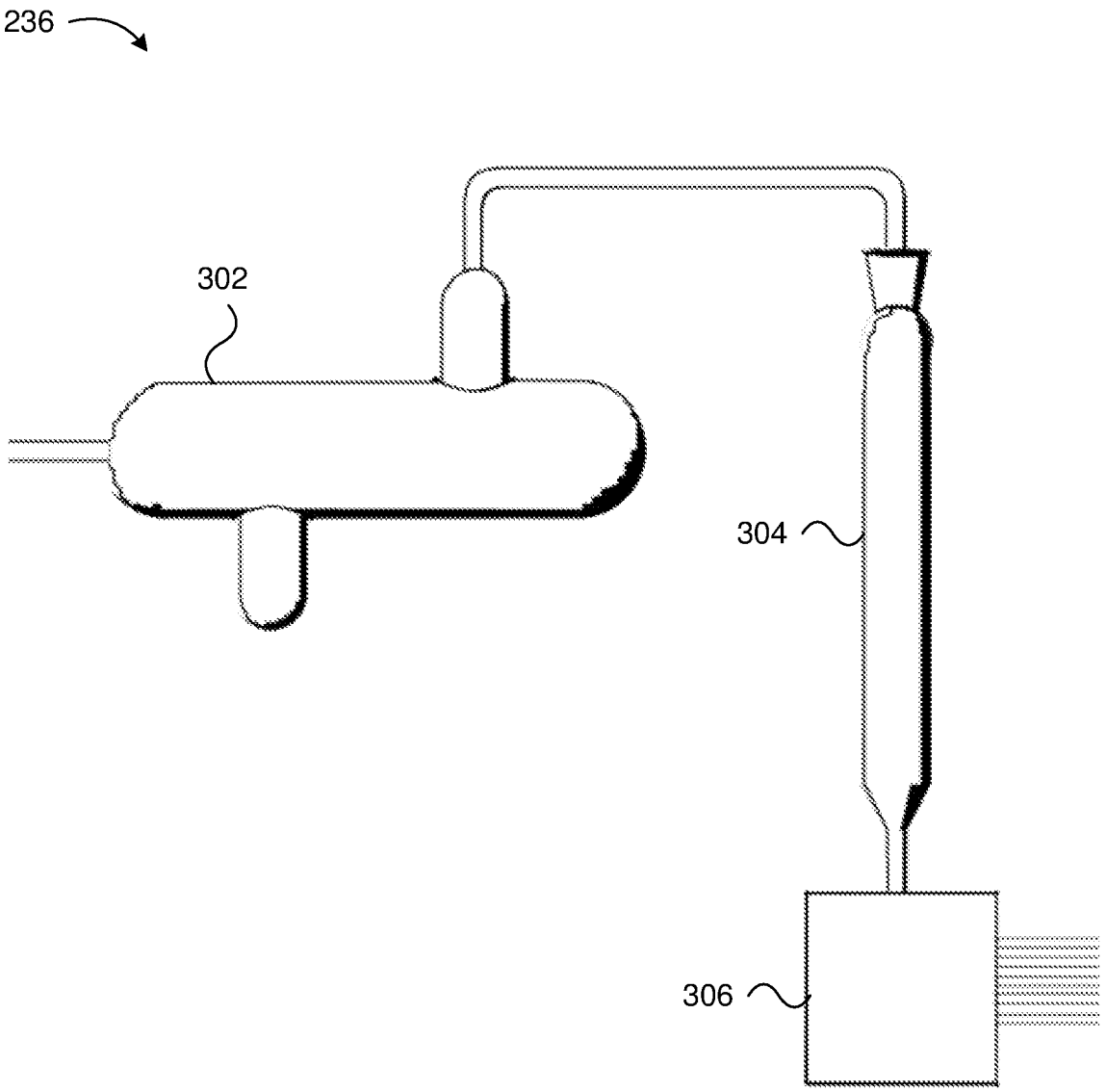
FIG. 3 is a diagram illustrating a steam temperature control subsystem, according to various embodiments.

FIG. 3 is a diagram illustrating one embodiment of a steam temperature control subsystem 236, as described above. In the depicted embodiment, the steam temperature control subsystem 236 includes heaters 302, 304 and one or more steam/water mixers 306, which are described below.

Lines, pipes or other connectors between components or subsystems in the Figures are intended, as in an electrical schematic diagram, to indicate how components or subsystems are coupled together and are not intended to imply exact spatial relationships between components. For example, the vertical and/or horizontal positions of heaters 302, 304 and steam/water mixers 306 in a system 100 may or may not be as depicted in FIG. 3, but the flow of steam between the components is illustrated by pipes. In the depicted embodiment, the steam temperature control subsystem 236 receives steam from the shale combustion subsystem from the pipe depicted entering the left of FIG. 3, and delivers steam to steam distributors at various portions of the retort 234 via the pipes depicted exiting the right of FIG. 3.

In general, in various embodiments, a steam temperature control subsystem 236 is coupled to steam distributors at the retort 234, and is configured to deliver higher-temperature steam to one or more upper sections of the retort 234 and lower-temperature steam to one or more lower sections of the retort 234. With crossflow of steam across the retort 234 from a first side to a second side, delivering higher temperature steam to the upper portion of the retort 234 heats shale near the first side to a hot enough temperature for pyrolysis in the upper portion. Then, as the shale descends through the retort 234, delivering lower temperature steam to the lower portion of the retort 234 cools the already pyrolyzed shale near the first side and drives a zone of higher temperature towards the second side of the retort 234 to pyrolyze shale in the interior of the retort 234 and at the second side. This process is described in further detail below with reference to FIG. 4.

In some embodiments, a steam temperature control subsystem 236 includes one or more heaters 302, 304 for increasing steam temperature. In the depicted embodiment, the steam temperature control subsystem 236 includes two heaters 302, 304. In another embodiment, a steam temperature control subsystem 236 may include more or fewer heaters. In the depicted embodiment, heater 302 is a combustion heater (e.g., an oxy-fuel burner or an air-fuel burner) that burns fuel to increase the temperature of the steam received from the shale combustion subsystem 204. In other embodiments, the heaters 302, 304 is heated by different heat sources, such as combustion heat, electrical heat, waste heat, etc. The heater 302, in other embodiments, includes multiple stages. In some embodiments, the steam temperature control subsystem 236 includes sensors, steam/water mixers 306, a feedback system, and the like to produce steam at specific temperatures at various steam distributors in the retort 234 and elsewhere.

As depicted in FIG. 3, a heater 302 may be disposed in or preceded by a liquid/gas separator to remove any condensate from the incoming steam. In the depicted embodiment, heater 304 is an electric heater that uses one or more resistive heating elements (such as CALROD® heating elements) to increase the temperature of the steam. Various other or further types of heaters may similarly be used to increase steam temperature in a steam temperature control subsystem 236.

At times, steam received by the steam temperature control subsystem 236 from the shale combustion subsystem 204 may already be at or above the highest temperature that the steam temperature control subsystem 236 provides to the retort 234, in which case heaters 302, 304 may not be used. However, at other times, steam may not be available from the shale combustion subsystem 204 (e.g., at plant startup), or may be at a lower temperature than desired. Using one or more heaters 302, 304 provides a buffer between the shale combustion subsystem 204 and the retort 234 for reheating or producing steam.

In the depicted embodiment, the steam temperature control subsystem 236 includes a plurality of steam/water mixers 306 for reducing steam temperature to a plurality of different temperatures for delivery to different portions of the retort 234. Steam/water mixers 306 are depicted collectively as a black box in FIG. 3, but may in reality be disposed near each other or at spatially distant locations in different steam lines. In various embodiments, steam/water mixers 306 may be commercially available attemperators, or the like, which reduce steam temperature by mixing the steam with water. Thus, the steam temperature control subsystem 236 may output steam at a variety of temperatures by heating steam to a high temperature, splitting the heated steam into different output lines, and reducing or increasing the temperature of the steam in one or more of the output lines. The output lines thus convey steam at different temperatures to the retort 234.

Figure 4:
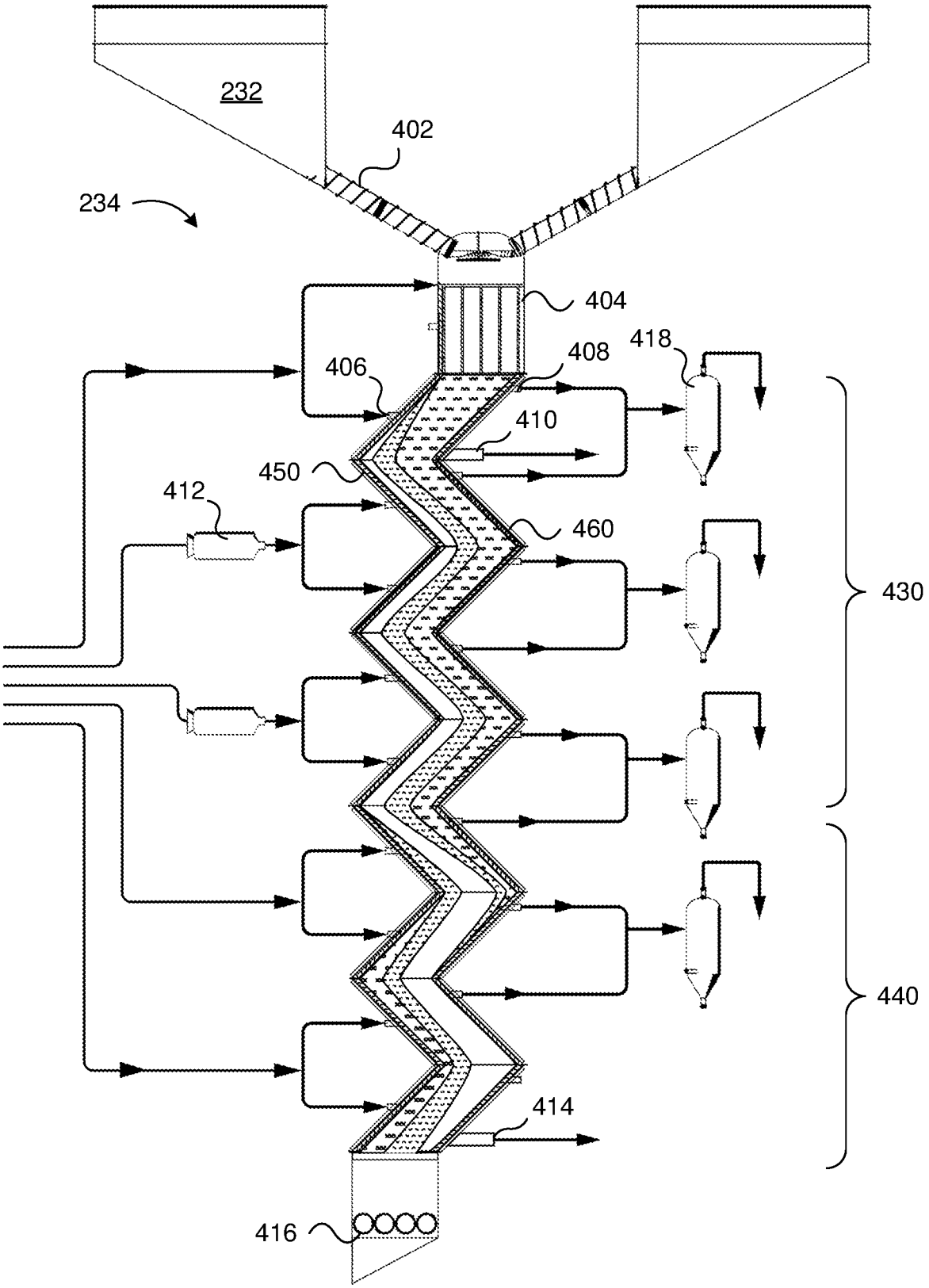
FIG. 4 is a diagram illustrating a retort, according to various embodiments.

FIG. 4 is a diagram illustrating one embodiment of a retort 234, with associated components for a shale pyrolysis system 100 as described above. The retort 234 and certain other components are shown in cross section, in a side view, to illustrate internal components. Certain lines inside the retort 234 are illustrations of shale flow or heat flow through the retort 234, and not of the physical structure of the retort 234. As in FIG. 3, lines or other connectors between components or subsystems indicate the flow of steam or other gases between components, as in an electrical schematic diagram, to indicate how components or subsystems are coupled together and are not intended to imply exact spatial relationships between components. Additionally, various components depicted in the Figures may be omitted in some embodiments of a system 100, and/or various components omitted from the Figures may be included in some embodiments of a system 100. For example, although FIG. 3 depicts nine angled sections of a retort 234, a retort 234 in another embodiment may have more or fewer than nine sections.

Shale is loaded into the retort 234 at or near the top, is pyrolyzed as it descends through the retort 234, and is removed from the bottom of the retort 234. The retort 234 includes a first side 450 (depicted to the left in FIG. 4), and a second side 460 (depicted to the right in FIG. 4) opposite the first side 450. In the depicted embodiment, the first and second sides 450, 460 include descending angled surfaces at alternating angles to produce zig-zag motion of shale descending through the retort 234. The first and second sides 450, 460, in the depicted embodiment, both have zig-zag shapes produced by the descending angled surfaces at alternating angles. Other sides of the retort 234 that couple the first side 450 to the second side 460, not shown in the cross section view of FIG. 4, (e.g., a front side and a back side) may be flat. In other embodiments, the other sides include horizontal ridges that contribute to tumbling of the shale.

The first and second zig-zag sides 450, 460 are aligned so that descending angled surfaces of both sides are parallel (or substantially parallel) producing a channel for descending shale where the width of the channel, or the horizontal area of the channel at different points, is constant or substantially constant. The retort 234 is operated when filled with shale, and the shale may be moved as a (not strictly vertical) column of solid shale particles, rather than being gas-fluidized or liquid-fluidized. Downward but angled motion of the shale at alternating angles between zig-zag sides produces shear between different horizontal planes or of the shale, preventing the shale particles from fusing together, as described below. Each section of the retort 234 supports a portion of the shale, which reduces pressure within the shale to less than pressures required for fusing shale particles. Angled surfaces support the descending shale, reducing geo load at the bottom of the retort 234.

In some embodiments, angled sections of the retort 234 can be individually assembled and transported on standard-size trucks, then assembled at the location where the retort 234 will be operated. Sections may include outer steel surfaces of the retort 234, which may be flange-bolted together, insulation, and distributors 406 or collectors 408 which are described below.

Shale is conveyed to hoppers 232. In some embodiments, shale may be mined and groomed 4 inch (10.6 centimeters ("cm")) minus shale, with a particle size of four inches or less. Having 4 inch minus shale is beneficial in reducing costs in preparing the shale for pyrolysis. In some embodiments, hoppers 232 may be alternately filled and emptied, so a first hopper is filled while shale is loaded into the retort 234 from a second hopper, and vice versa.

One or more augers 402, conveyors, etc. load shale from the hoppers 232 into a preheat section 404 of the retort 234. Shale is loaded at the top of the retort 234 and removed from the bottom of the retort 234 while the retort 234 is running, so the shale is loaded into the retort 234 through one or more gas and mechanical interlocks that prevent gases from flowing backwards out of the retort 234 to augers 402 and hoppers 232. In some embodiments a deflector cone or wedge is disposed at the ends of the one or more augers 402, to direct shale particles downward into the retort 234.

Lines with arrows in FIG. 4 represent the flow of steam into the retort 234 from the steam temperature control subsystem 236 at the left side of FIG. 4, and the flow of steam, gases, and liquids out of the retort 234 at the right side of FIG. 4. Superheated steam enters the preheat section 404 of the retort 234, and is distributed through the shale particles to preheat the shale through preheat steam distributors, which are described below with reference to FIG. 5.

Shale descending out of the preheat section 404 enters a first angled section of the retort 234. The shale descends down through subsequent angled sections of the retort 234 in zig-zag fashion. In some embodiments, flow of the shale is laminar rather than turbulent, so that shale particles tend to stay in zig-zag "lanes" without a large degree of mixing across the horizontal x-y plane. The shale moving through the retort 234 in lanes is facilitated more readily with rounded corners, as depicted in more detail with regards to the retort 1200 of FIGS. 12A-D and as shown in FIG. 13.

Oblique descending motion of the shale at alternating angles may facilitate high volume flow with the shale being resident in the retort for longer periods for faster shale processing. The zig-zag design of the retort 234 is longer than a straight vertical drop by a factor of 1.41. The zig-zag design also causes consistent shear between x-y planes to avoid fusing shale particles together. A vertical retort would cause high pressure on the shale at the bottom, which would cause fusing of shale particles. The zig-zag design of the retort 234 allows shale moving through the retort to be supported at each turn to maintain pressures well below pressures that would cause fusing of the shale particles. Shale particles typically fuse at pressures around 40-50 pounds-per-square-inch ("PSI"). The length of each section of the retort 234 along with a horizontal width of the retort 234, in some embodiments, are chosen so that pressures on the shale in the retort 234 are less than about 10 PSI, which is well below fusing pressures.

The zig-zag design of the retort 234 contribute to consistent transfer of heat and pyrolyzed gases/vapors across the retort 234 (as described below) along with a slight tumbling of shale particles against each other to facilitate heat transfer and changing gas pathways across the retort 234 between moving shale particles resulting in even heat transfer. Heat transfer by convection, conduction and radiation across the tumbling shale particles is facilitated by changing heat transfer pathways between the moving shale particles.

At the bottom of the retort 234, a gas interlock prevents gases from exiting the retort 234 with the spent (e.g., pyrolyzed) shale. In some embodiments, one or more grinders 416 grind the shale exiting the retort 234. A shaker grate may be disposed above the grinders 416, in some embodiments, to control the descent of the shale. In the depicted embodiment, grinders 416 control the flow of shale out of the retort 234. The speed of the grinders 416 may be controlled by a retort operator to control the volume flow of shale through the retort 234. In some embodiments, primary grinders 416 may be provided to control the flow of shale, and secondary grinders (not shown) may be provided to grind the shale more finely than the primary grinders 416. In other embodiments, a conveyor at the bottom of the retort 234 conveys shale away from the bottom of the retort 234 and controls the volume of flow of shale through the retort 234. Spent shale from the retort 234 has had oil and gas products from kerogen pyrolyzed and removed, but includes carbon that may be combusted at temperatures higher than pyrolysis temperatures. The spent shale, in various embodiments, may be transported to a shale combustion subsystem 204 as described above. A shale combustion subsystem 204 is described in further detail below with reference to FIGS. 9 and 10.

In the depicted embodiment, steam distributors 406 are coupled to a first side 450 of the retort 234, and collectors 408 are coupled to the second side 460 of the retort 234. Superheated steam is used to heat and pyrolyze the shale, producing oil and gas products from kerogen in the shale, which are removed from the retort 234 as gases and vapors. The term gases may also be used herein in a general sense to refer to gases and/or vapors. The distributors 406 and collectors 408 are coupled to the first and second sides 450, 460, respectively, to produce crossflow of steam and heat from the first side 450 to the second side 460, across the shale particles descending through the retort 234. Gases produced by shale pyrolysis are entrained in the crossflow of steam, and exit the collectors 408. Gases and steam move substantially horizontally as gases and steam flow to a nearest pressure relief in the form of collectors 408. The gases moving substantially horizontally includes slight variations in horizontal movement caused by tumbling of shale particles, movement of the shale vertically, changes in pressure within the shale, and other reasons known to those of skill in the art.

A steam temperature control subsystem 236 produces the superheated steam. In some embodiments, if some portions of the steam temperature control subsystem 236 are located at a distance from the retort 234 that allows steam to cool, the steam temperature control subsystem 236 may include one or more additional heaters 412 located nearer to the retort 234, to boost steam temperatures for steam delivered to certain portions of the retort 234. The steam temperature control subsystem 236 may be coupled to the steam distributors 406, and may be configured to deliver higher-temperature steam to one or more upper sections 430 of the retort 234 and lower-temperature steam to one or more lower sections 440 of the retort 234. In the depicted embodiment, the upper sections 430 of the retort 234 includes the upper five angled sections, and the one or more lower sections 440 of the retort 234 includes the lower four angled sections. In another embodiment, upper and lower sections 430, 440 may be divided differently.

Shale in the retort 234 is preconditioned in the preheat section 404, which is described below. The preconditioning, in some embodiments, heats the shale to a point where steam from the distributors 406 is not condensed moving to the collectors 408.

Higher temperature steam from the steam temperature control subsystem 236 enters the first side 450 of the retort 234 at distributors 406 in the upper sections 430 of the retort 234. In some embodiments, higher-temperature steam may be at or above a shale pyrolysis temperature. For example, if pyrolysis occurs at 675° F., higher temperature steam may be at a temperature of approximately 800° F. In some embodiments, distributors 406 at the top two sections of the upper sections 430 provide steam at around 675° F., distributors 406 of the next two sections of the upper sections 430 provide steam at around 800° F., and distributors 406 of the bottom section of the upper sections 430 provide steam at around 1200° F. Thus, elements of kerogen of the shale in the retort 234 with a lower boiling point vaporize near the top of the retort 234, elements of the kerogen with somewhat higher boiling points vaporize in the mid sections of the upper sections 430, and elements of the kerogen with even higher boiling points vaporize at the highest temperature section of the upper sections 430.

Lower-temperature steam from the steam temperature control subsystem 236 enters the first side 450 of the retort 234 at distributors 406 in the one or more lower sections 440 of the retort 234. Lower-temperature steam may be superheated steam, above the boiling point of water to avoid condensation in the retort 234, but may be at a significantly lower temperature than the higher temperature steam. For example, in one embodiment, the lower temperature steam entering the one or more lower sections 440 of the retort 234 may be cooled (by mixing with water) to approximately 400° F. in some lower sections 440 and to 250° F. in the bottom lower sections 440.

Steam in the preheat section 404 of the retort 234 may condense on cold shale as it preheats the shale. In the upper sections 430 of the retort 234, crossflow of superheated steam may drive the condensate across the retort 234 to one or more water collectors 410. Preheating of shale and removal of condensed water avoids the need to heat the condensed water back up to shale pyrolysis temperatures while heating the shale. Preheating the shale and removing the condensed water also prevents superheated steam distributed in lower sections of the retort 234 from condensing on the shale.

In the upper sections 430 of the retort 234, higher-temperature steam heats the shale from the first side 450, driving a wave or gradient of heat across the shale from the first side 450 to the second side 460. In FIG. 4, shading within the retort 234 indicates temperature zones or heat waves, with white or no shading (e.g., at the left of the upper sections 430 of the retort 234) indicating the highest temperatures, large dashes (e.g., at the right of the upper sections 430 of the retort 234) indicating the lowest temperatures, and small dashes indicating intermediate temperatures. Heat moves from the first side 450 to the second side 460 by convection of the steam and pyrolyzed gases, conduction between shale particles, and radiation from hot shale particles and retort sides. As the shale heats up, pyrolysis produces oil and gas products in gaseous form, which exit through collectors 408.

In the one or more lower sections 440 of the retort 234, lower-temperature steam cools the shale. Crossflow of the lower-temperature steam continues to drive heat across from the first side 450 of the retort 234 to the second side 460. Thus, shale at the first side 450 of the retort 234 is pyrolyzed in the upper sections 430, where shale at the second side 460 of the retort 234 is not yet fully heated, and shale at the second side 460 of the retort 234 is pyrolyzed in the one or more lower sections 440 as heat transfers across from the first side 450, despite the overall cooling of the shale in the one or more lower sections 440.

Gases and vapors at different temperatures exit different sections of the retort 234 through collectors 408. Some vapors of heavier oils may be driven across the retort 234 to the second side 460 and run down the second side 460 as liquids. Liquids near the top of the second side 460 typically vaporize due to increasing temperatures moving down through the retort 234. Some liquids reach the bottom or lower sections 440 of the retort 234 and, in some embodiments, are removed via one or more oil collectors 414. Gases exiting the retort 234 via collectors 408 may be directed through a mesh (not shown) and/or cyclonic separators 418 to remove fine particles entrained in the exiting gases, and may then enter a distillation subsystem 240, which is described below. Liquids exiting the retort 234 (e.g., via one or more water collectors 410 and/or oil collectors 414 may be heated to vaporize the liquids and separate them from solids (e.g., fine shale particles) suspended in the liquid, and the resulting vapor may also enter the distillation subsystem 240. For example, the oil collector may be coupled to higher-temperature steam to vaporize collected oil.

Although the above description broadly describes delivery of higher-temperature and lower-temperature steam to the retort 234, the steam temperature control subsystem 236 may use heaters 302, 304 and/or steam/water mixers 306 to produce steam at a plurality of different temperatures for delivery to different portions of the retort 234. In one embodiment, the steam/water mixers 306 are configured to produce steam above 600° F. for distribution to a preheat section 404 of the retort 234. In some embodiments, steam/water mixers 306 are configured to produce steam at or above 625° F., at or above 650° F., or at or above 675° F. for distribution to a preheat section 404 of the retort 234.

In one embodiment, the steam/water mixers 306 are configured to produce steam above 750° F. for distribution to one or more upper sections 430 of the retort 234. In some embodiments, steam/water mixers 306 are configured to produce steam at or above 800° F., at or above 850° F., at or above 900° F., or at or above 950° F. for distribution to one or more upper sections 430 of the retort 234.

In one embodiment, the steam/water mixers 306 are configured to produce steam below 300° F. for distribution to a one or more lower sections 440 of the retort 234. In some embodiments, steam/water mixers 306 are configured to produce steam at or below 275° F., at or above 250° F., or at or below 225° F. for distribution to one or more lower sections 440 of the retort 234. In some embodiments, sensors (not shown) at or near the collectors 408 provide feedback to the steam temperature control subsystem 236, which adjusts steam/water mixers 306 to raise or lower steam temperature at various distributors 406 to maintain vapor collection at the collectors 408 at specified temperatures.

For example, a temperature sensor at a collector 408 at the first two sections of the upper sections 430 may be set to 250° F., which may then be used to adjust a volume of steam at the corresponding distributors 406 on the first side 450 of the section to maintain vapor collection at 250° F. In other embodiments, the steam temperature control subsystem 236 adjusts the temperature of the steam to above or below 675° F. to maintain vapor collection at 250° F. In some embodiments, the temperature of the gases leaving the first two sections of the upper sections 430 are in the range of between 250° F. and 300° F.

In some embodiments, collectors 408 are ganged together for two sections. For example, the collectors 408 of the top two sections are ganged together, collectors 408 for the next two sections are ganged together, etc. Temperature sensors into sections with a common collector 408, in some embodiments, are set to a same value. In some embodiments, temperatures are maintained in the top two sections between 250° F. and 300° F. and each subsequent pair of sections has an increase of about 150° F. So if the first two sections are set to 250° F. with steam at the distributors 406 set to 675° F., the next two sections are set to 400° F. with steam at corresponding distributors 406 set to 800° F., and the next two sections are set to 550° F. with steam at the fifth section distributors 406 set to 1200° F., but the sixth section distributors 406 have steam at 400° F. In other embodiments, temperatures of the temperature sensors and steam from the distributors 406 are set to different temperatures.

Although the use of steam is described herein for heating and pyrolyzing shale, hot gases other than steam may be used in some embodiments to similarly heat and pyrolyze shale. In further embodiments, the structures described herein as steam distributors 406 and collectors 408 may be used as hot gas distributors and collectors. In the embodiments, the boilers have a working fluid other than water.

Figure 5:
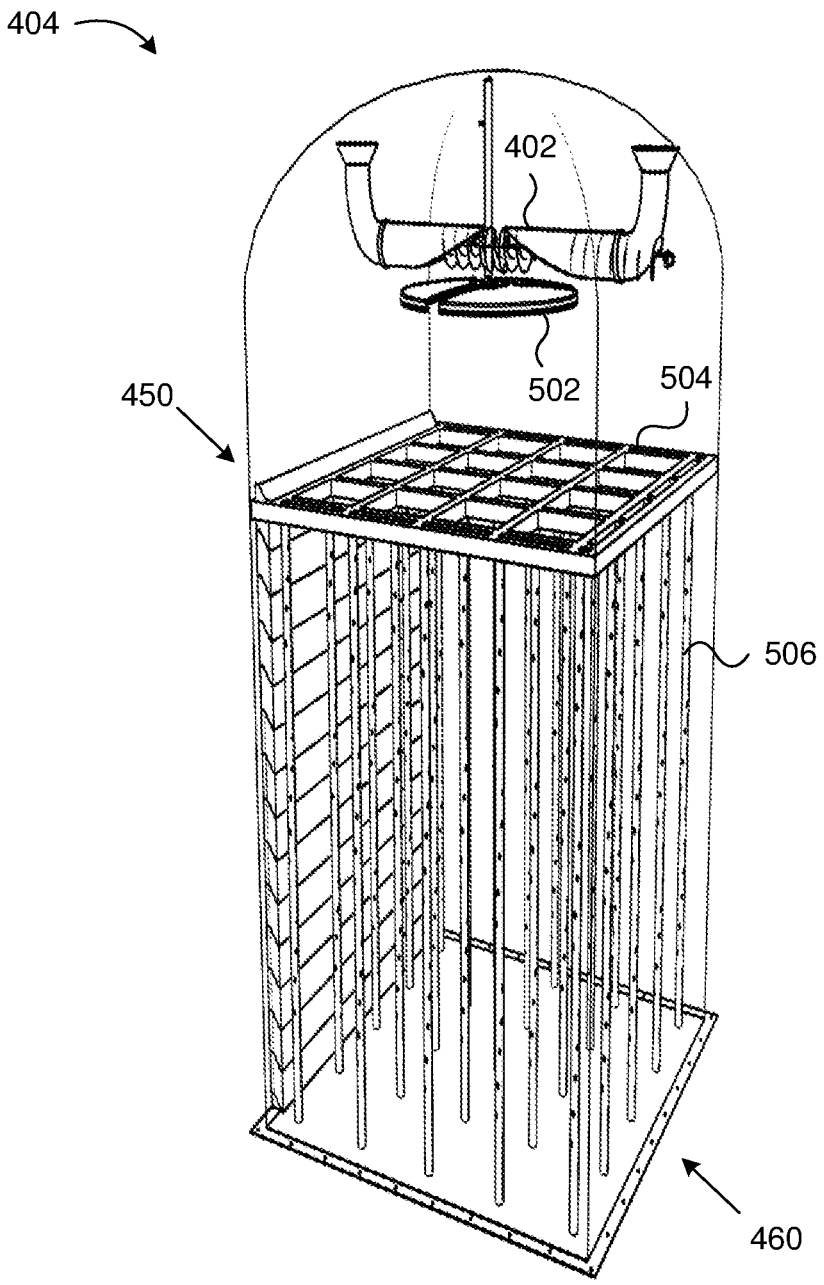
FIG. 5 is a perspective view illustrating a preheat section for a retort, according to various embodiments.

FIG. 5 is a perspective view illustrating one embodiment of a preheat section 404 for a retort 234. As in FIG. 4, certain exterior components have been omitted to depict components in the interior of the retort 234. As described above, the preheat section 404 in the depicted embodiment receives and preheats shale entering the top of the retort 234. In the depicted embodiment, augers 402 move shale from hoppers 232 into the retort 234, and a deflector cone 502 at the ends of the augers 402 directs direct shale particles downward into the retort 234. Unlike in other sections of the retort 234, where steam distributors 406 are coupled to the first side 450, the preheat steam distributors 506 in the preheat section 404 are disposed between the first side 450 and the second side 460 to distribute steam more uniformly within the shale bed. This more uniform distribution of steam may increase the temperature of the shale above the boiling point of water across the preheat section 404, thus avoiding cold spots where superheated steam added lower in the retort 234 might condense.

In the depicted embodiment, the preheat steam distributors 506 are hollow vertical rods with side ports. These hollow vertical rods 506 (e.g., preheat steam distributors 506) extend downward from a grate 504 with hollow members for receiving steam and distributing steam to the hollow vertical rods 506. In other embodiments, steam is distributed using corkscrew shaped rods, horizontal rods, or other shapes to provide steam throughout the preheat section 404. Thus, steam provided to the preheat section 404 enters the grate 504 and the hollow vertical rods 506, and exits the rods 506 into the shale bed via the side ports in the rods 506. The use of a grate 504 and hollow vertical rods 506 or hollow rods of another shape to distribute steam allows the shale to travel vertically through the preheat section 404, while steam is distributed to preheat shale across the retort 234 rather than only at the first side 450. However, in various other embodiments, preheat steam distributors 506 of various other or further shapes may be used to preheat shale entering the top of the retort 234.

Spacing of the vertical rods 506 is chosen to provide enough steam to heat the shale entering the preheat section 404 to heat the shale so that steam does not condense on or around the shale. In some embodiments, the steam from the vertical rods 506 pyrolyzes shale around the vertical rods 506, which then transfers heat to surrounding shale. Shale particles around the vertical rods 506 may be at or near the temperature of the steam but shale particles further away from the vertical rods 506 are at a lower temperature but are coated with heated water from the steam which then allows the shale particles to begin the pyrolysis process in the retort 234 below. Temperature of the steam, the number of vertical rods 506, the volume of steam, etc. are chosen so that steam in the first section of the retort 234 does not condense and drip out. In some embodiments, for any steam that does condense, the first section of the retort includes a water collector 410. In other embodiments, other sections such as the second section of the retort 234 includes a water collector 410.

Figure 6:
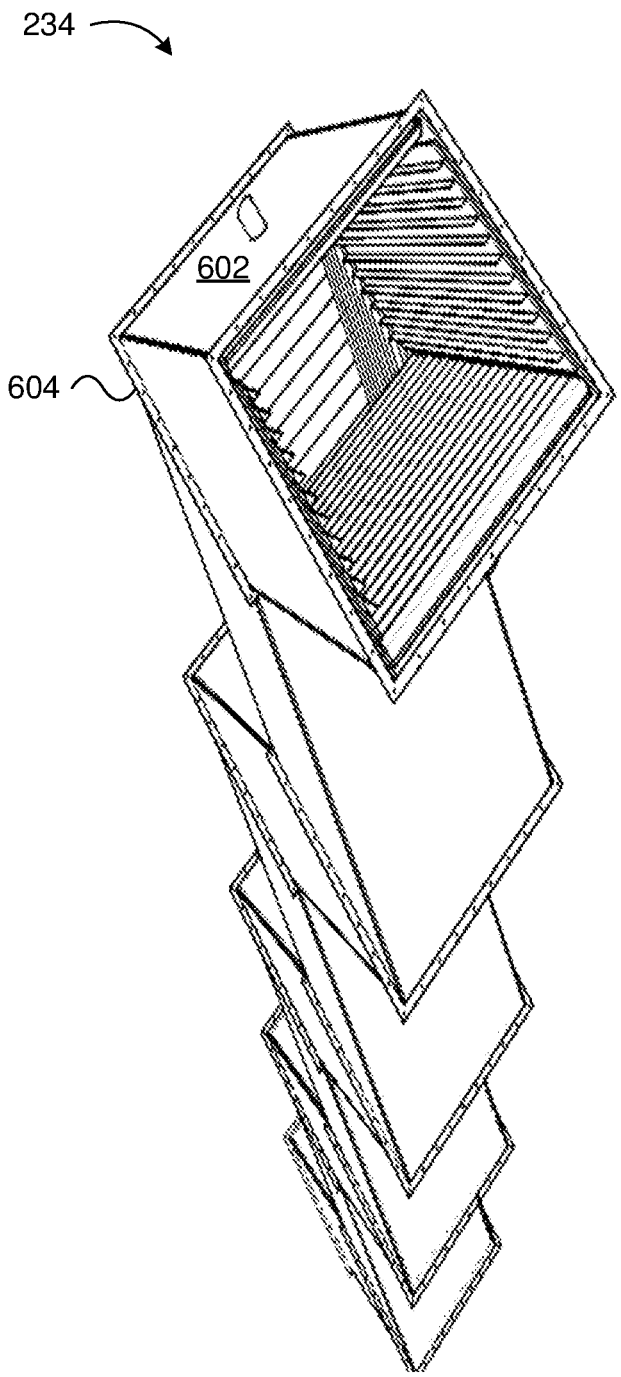
FIG. 6 is a perspective view illustrating a portion of a retort below a preheat section, according to various embodiments.

FIG. 6 depicts the retort 234 in a perspective view, looking down into the retort 234 from below the preheat section 404. Individual angled sections 602 of the retort 234 may be transported separately, and bolted together at flanges 604. Additionally, some components that were omitted for clarity in FIG. 4, such as front and back walls, are depicted in FIG. 6. Ribs on the flat front and back sides of the retort 234 prevent steam and pyrolysis gases from skirting around the perimeter of the shale bed.

Figure 7A:
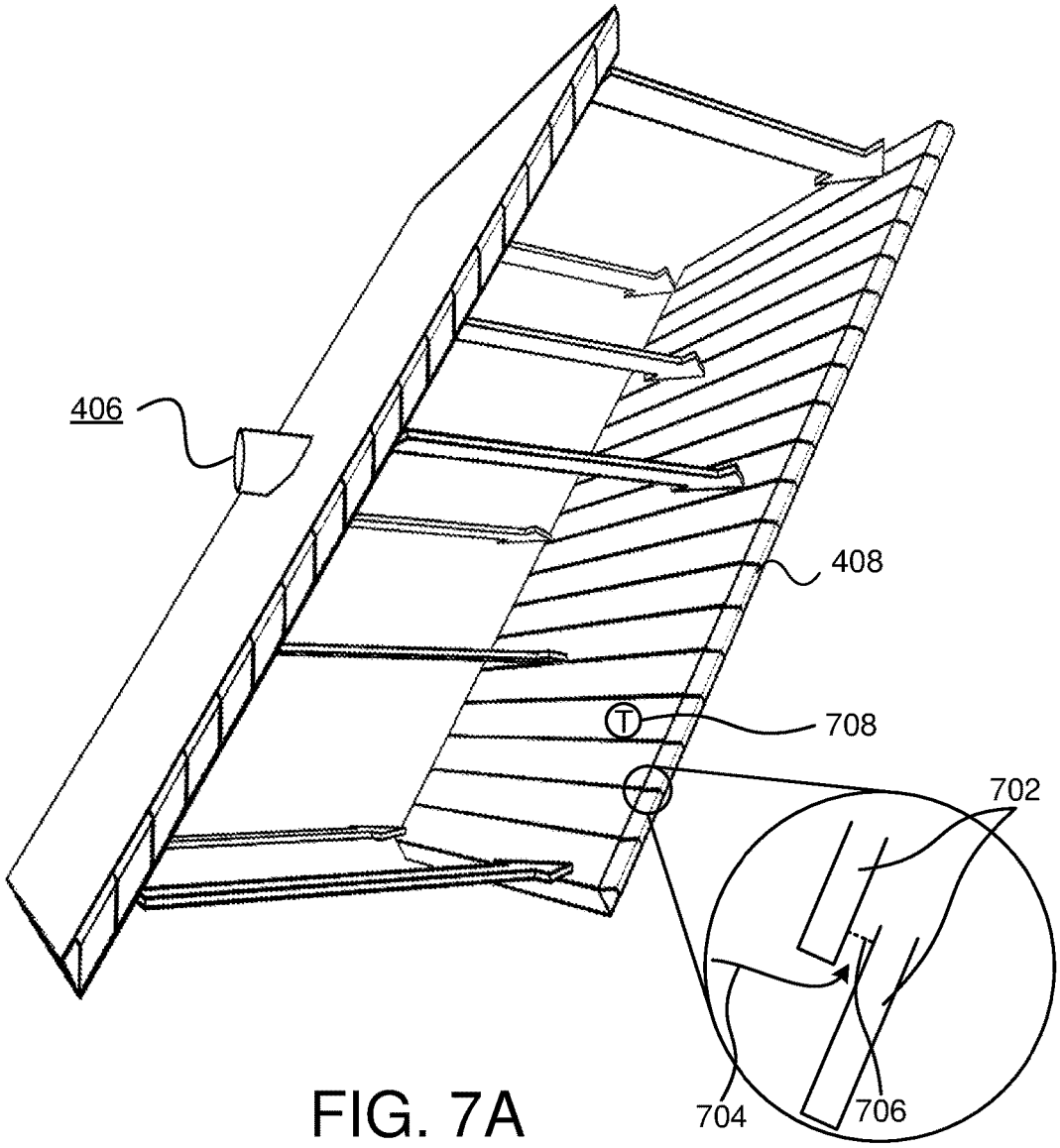
FIG. 7A is a perspective view illustrating a steam distributor and a collector for a retort, according to various embodiments.

FIG. 7A depicts a steam distributor 406 and a collector 408 for a retort 234, in one embodiment. Arrows illustrate the flow of steam from the distributor 406 to the collector 408, across the retort 234. In some embodiments, distributors 406 and collectors 408 are made of steel, which is treated as sacrificial. Sacrificial distributors 406 and collectors 408 may be replaced when the retort 234 is serviced. A distributor 406 or a collector 408 includes a first side with a large hole, a second side with small slots or holes, and an air gap between the first and second sides. In one embodiment, the sides may be two inches (5.08 cm) thick, and the air gap may be six inches (15.24 cm) thick. For distributors 406, steam enters from the steam temperature control subsystem 236 through the large hole, passes through the air gaps and exits the distributor 406 to heat shale particles in the retort 234 through the small slots. For collectors 408, steam and other gases exit the shale and enter the collector 408 through the small holes, cross the air gap, and are removed from the retort 234 through the large hole. In some embodiments, collectors 408 may include a filter medium such as coiled steel or mesh in the air gap, to remove particles from the exiting gases.

In some embodiments, distributors 406 and/or collectors 408 in various sections of the retort 234 may be separated from outer walls of the retort 234 by insulation. Outer walls of may be bolted or otherwise fastened together, and may be air-cooled. Due to air cooling and insulation, outer walls may be at a lower temperature than distributors 406 and/or collectors 408, and may therefore expand less than distributors 406 and/or collectors 408. Accordingly, distributors 406 and/or collectors 408 may be shorter or smaller than outer walls of corresponding sections of the retort 234, so that expansion of the distributors 406 and/or collectors 408 does not push the sections of the retort 234 apart.

An expanded section is depicted showing two plates 702 (not to scale) illustrating how the collectors 408 allow vapor to enter the collectors 408 while liquids are prevented from moving into the collectors 408. A vapor pathway 704 shows the vapor changing direction to move up into a gap between the plates 702. A mesh 706 of some type keeps small particles from entering the collector 408. Liquid kerogen may run down the second side 460 angled right to left, but temperature increases from section to section so that eventually the liquid running down a collector 408 will eventually reach the boiling point of the kerogen and will vaporize and enter a slot between plates and go to a collector 408.

Figure 7B:
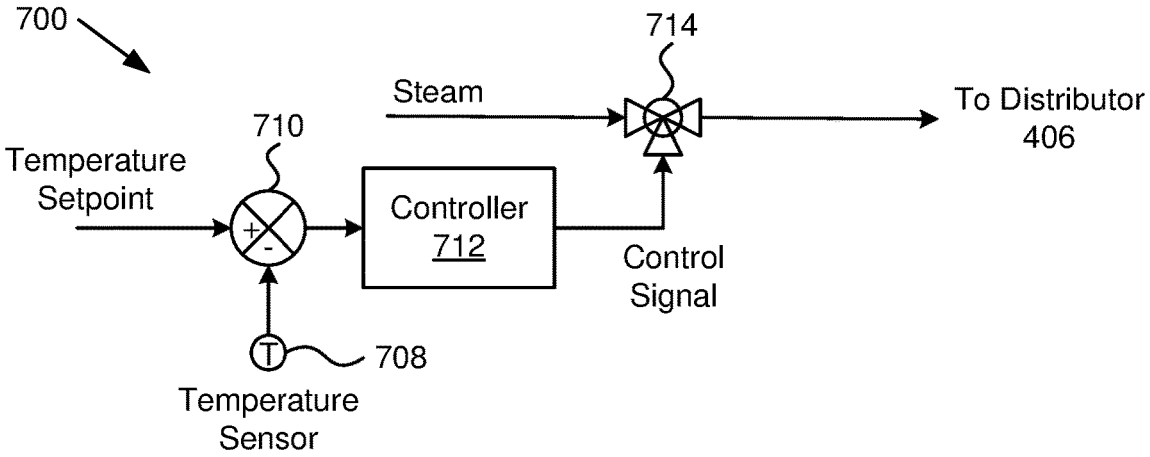
FIG. 7B is a schematic block diagram illustrating a feedback control section of a portion of a steam temperature control subsystem, according to various embodiments.

FIG. 7B is a schematic block diagram illustrating a feedback control section 700 of a steam temperature control subsystem 236, according to various embodiments. The feedback control section 700 includes the temperature sensor 708 described above, a summation block 710, a controller 712, and a mixing valve 714, which are described below. The summation block 710 sums output from the temperature sensor 708 and a temperature setpoint. In some embodiments, the summation block 710 is a comparator. An error signal from the summation block 710 is fed to a controller 712, which outputs a control signal that controls a mixing valve in a steam line to one or more distributors 406 in a same section of the retort 234 as the temperature sensor 708. As temperature at the temperature sensor 708 increases relative to the setpoint temperature, the controller 712 causes the mixing valve 714 to reduce steam to the distributor 406. As temperature at the temperature sensor 708 decreases relative to the setpoint temperature, the controller 712 causes the mixing valve 714 to increase steam to the distributor 406. The controller 712, in some embodiments, is a proportional-integral ("PI") controller, a proportional-integral-derivative ("PID") controller, a proportional controller, or the like. One of skill in the art will recognize compensation techniques for the controller 712.

Figure 8:
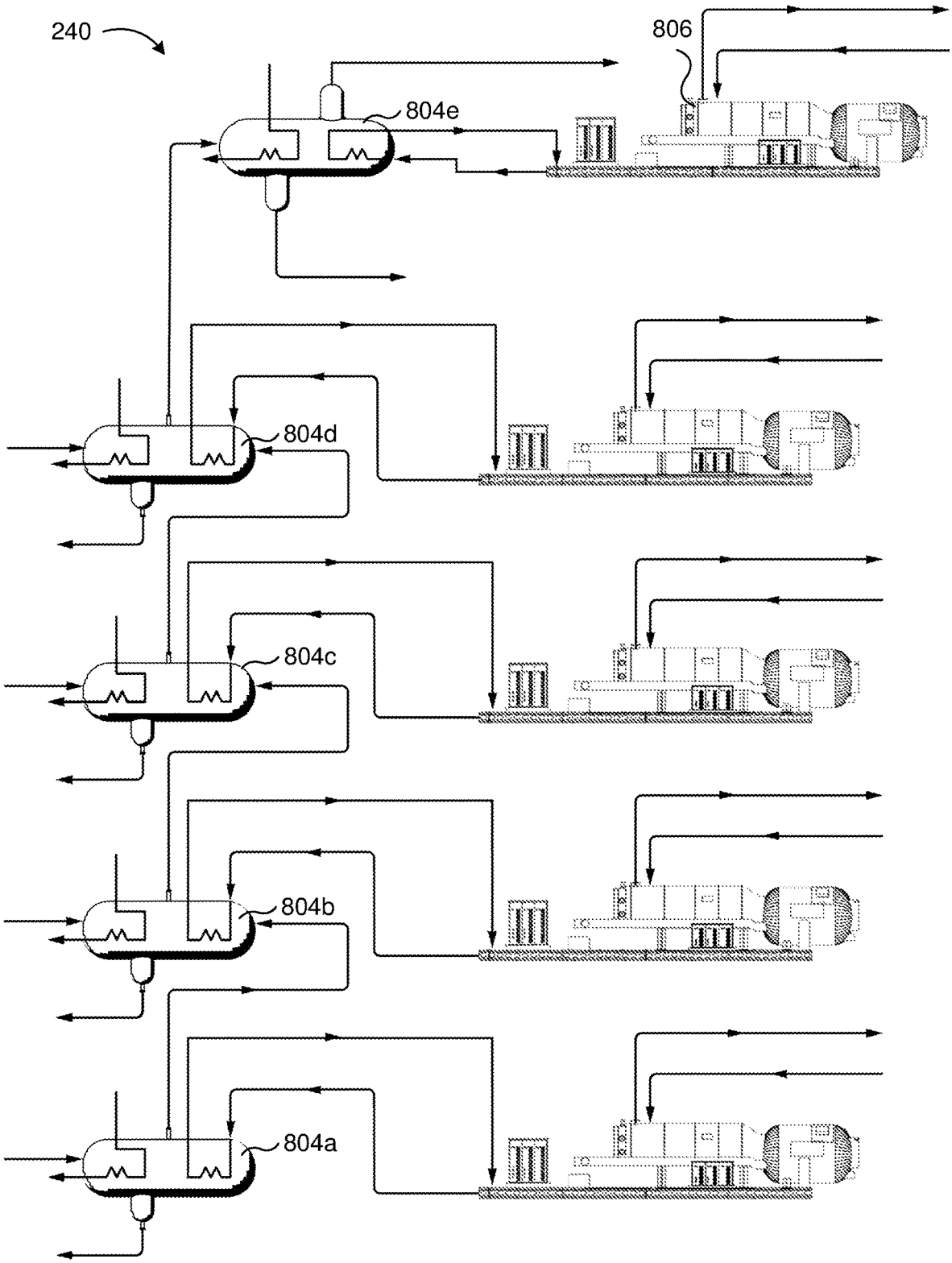
FIG. 8 is a diagram illustrating a distillation subsystem, according to various embodiments.

FIG. 8 is a diagram illustrating one embodiment of a distillation subsystem 240, as described above. In some embodiments, a distillation subsystem 240 includes a plurality of liquid/gas separation vessels 804*a-e* that receive gases from the retort 234, and a plurality of organic Rankine cycle (ORC) generators 806 corresponding to the separation vessels 804*a-c*. As in other diagrams herein, lines or pipes indicate connections or gas flow between components without indicating exact spatial relationships. Additionally, in various embodiments, a distillation subsystem 240 may include more or fewer separation vessels 804*a-e* and ORC generators 806. For example, FIG. 1 depicts a much larger number of ORC generators 806 in the distillation subsystem 240.

Gases (and liquids) exiting the retort 234 enter the distillation subsystem 240 at the left side of FIG. 8, having been filtered at cyclonic separators 418 to remove fine particles entrained in the exiting gases. As described above, gas fractions at different temperatures exit different sections of the retort 234, and are received by the distillation subsystem 240. Lighter hydrocarbons exit the retort 234 as shale particles are pyrolyzed, and may be found in gas fractions from multiple sections of the retort 234. Medium-weight to heavy hydrocarbons may be produced by pyrolysis at a pyrolysis temperature that is lower than the boiling point for those oils, and may condense on shale particles in the retort 234 as liquid. As the heat waves are driven across the retort 234 and the shale particles descend, medium-weight to heavy hydrocarbons may be volatilized lower in the retort 234 so that medium to heavy hydrocarbons exit the retort 234 in gas fractions from medium to low sections of the retort 234, and heavy hydrocarbons exit the retort 234 lower still. Thus, in general, gas fractions from the top of the retort 234 may include light hydrocarbons, gas fractions from the middle of the retort 234 may include light and medium hydrocarbons, and gas fractions from the bottom of the retort 234 may include light, medium, and heavy hydrocarbons.

The distillation subsystem 240 includes a plurality of liquid/gas separation vessels 804*a-e*, and a plurality of ORC generators 806 (or other heat-powered electrical generators) corresponding to the separation vessels 804*a-e*. The separation vessels 804*a-e* include heat exchangers through which the working fluid of the ORC generators 806 circulates, to transfer heat from the gas fractions to the working fluid. This heat transfer results in condensation of distillate products, which may be removed from the separation vessels 804*a-e* as liquids. The ORC generators 806 are coupled to and powered by heat exchangers of the separation vessels 804*a-c*. In some embodiments, ORC generators 806 may be TURBODEN® generators or other electrical generators powered by heating a working fluid. The ORC generators 806 produce electricity, and may be cooled by cooling water, which in turn may be circulated to ponds 220 where algae may use low grade waste heat. Flow of cooling water is indicated by arrows into and out of the ORC generators 806 at the right of FIG. 8. Cooling water may be provided to ORC generators from a common source, or may be provided to groups of ORC generators chained together so that the cooling water is gradually heated by multiple generators before being circulated to algae ponds 220.

The ORC generators 806 include a plurality of different working fluids (for different generators 806) which circulate through heat exchangers of corresponding separation vessels 804*a-c* in self-contained loops, thus producing different condensation temperatures for gases in different separation vessels 804*a-c*. In some embodiments, the combination of multiple liquid/gas separation vessels 804*a-e* with different condensation temperatures may function similarly to a distillation column to produce heavier and lighter oil fractions, which are removed from the liquid outputs of the liquid/gas separation vessels 804*a-e*, and stored in liquid storage tanks 252.

In the depicted embodiment, the separation vessels 804*a-c* include four separation vessels 804*a-d* for condensing hydrocarbons at different condensation temperatures, and a fifth separation vessel 804*e* for condensing water. In another embodiment, a system 100 may include more or fewer separation vessels. For example, to produce more or fewer than four different distillate fractions at different condensation temperatures, more or fewer than four separation vessels for condensing hydrocarbons may be provided.

In the depicted embodiment, the liquid/gas separation vessels 804*a-e* are coupled in a chain, so that gases exiting earlier separation vessels in the chain are received by later separation vessels in the chain. For example, the gas output of separation vessel 804*a* is coupled as an input to separation vessel 804*b*, the gas output of separation vessel 804*b* is coupled as an input to separation vessel 804*c*, the gas output of separation vessel 804*c* is coupled as an input to separation vessel 804*d*, and the gas output of separation vessel 804*d* is coupled as an input to separation vessel 804*c*. Chaining together of separation vessels 804*a-e* allows lighter hydrocarbons that are not condensed with the heavier oil fractions to transfer to subsequent separation vessels to be potentially condensed with lighter oil fractions. In the depicted embodiment, the gas output of separation vessel 804*d* includes gases that were not condensed in the separation vessels 804*a-d*, and removed as oil fractions. The non-condensed gases received by separation vessel 804*c* may include lighter hydrocarbons $C_1$-$C_6$, hydrogen, carbon dioxide, hydrogen sulfide, steam and/or water vapor.

In the depicted embodiment, two-stage distillation is performed at separation vessel 804*c* to condense water, which is removed from the vessel 804*e* as a liquid and stored in hot feedwater tanks 212. In some embodiments, a separation vessel may include two heat exchangers. In the depicted embodiment, two heat exchangers per separation vessel 804*a-e* are indicated as wavy lines inside the outline of the separation vessels 804*a-c*. One of the heat exchangers (to the right in FIG. 8) for a separation vessel 804*a-c* is coupled to the corresponding ORC generator 806, so that the working fluid for the ORC generator 806 circulates through that heat exchanger, and the boiling point of that fluid determines the temperature at which hydrocarbons condense within the separation vessel 804*a-c*.

In some embodiments, water distilled in separation vessel 804*e* may be circulated through second heat exchangers (to the left in FIG. 8) of the other separation vessels 804*a-d*, adding a portion of the latent heat of vaporization back to the water, thus allowing the water to be more rapidly boiled to produce steam in the shale combustion subsystem 204. Heat exchangers used to heat water at the separation vessels 804*a-d* may be chained together so that water passes through and is heated by a series of the separation vessels 804*a-d* prior to being stored in the feedwater tanks 212.

Water from the feedwater tanks 212 may be used to produce superheated steam in the shale combustion subsystem 204, as described below, or may be used by steam/water mixers 306 to control the temperature of superheated steam entering different sections of the retort 234, as described above. With the water removed at separation vessel 804*e*, other non-condensed gases, which may include lighter hydrocarbons $C_1$-$C_6$, hydrogen, carbon dioxide, and/or hydrogen sulfide are removed from the gas output of separation vessel 804*c*. These gases may be processed by a gas plant to separate, purify, or otherwise treat or use the gases, and stored in gas storage tanks 254.

Figure 9:
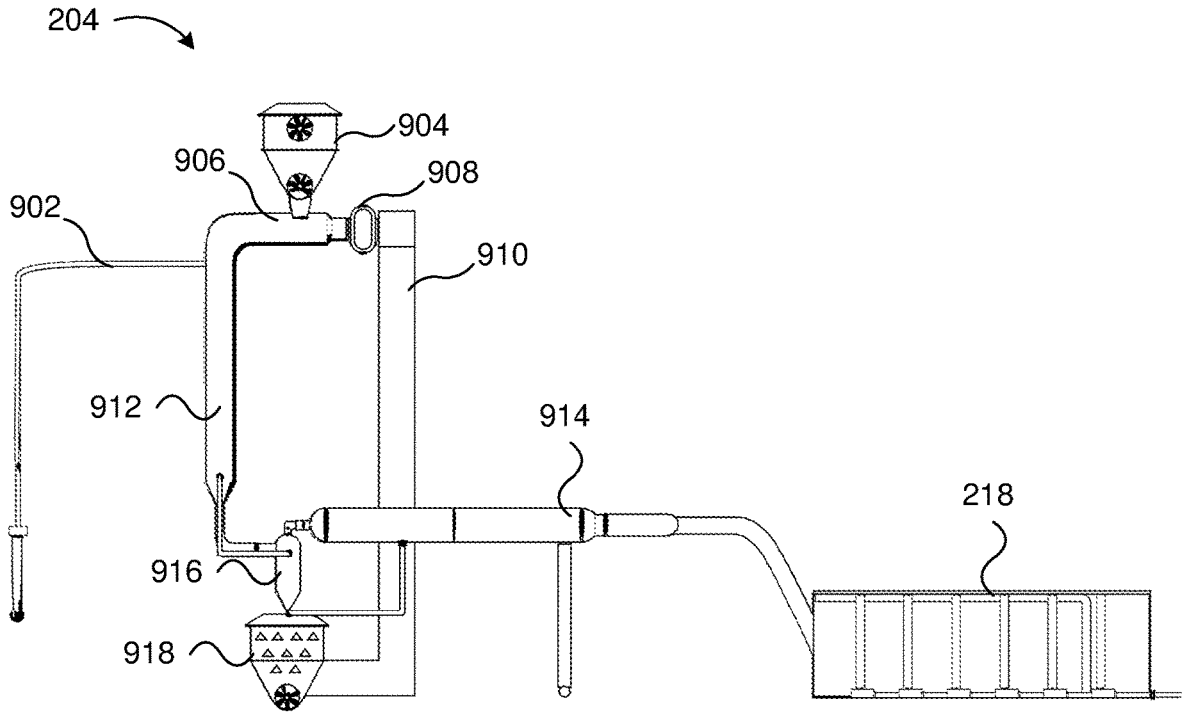
FIG. 9 is a diagram illustrating a shale combustion subsystem, according to various embodiments.

FIG. 9 is a diagram illustrating one embodiment of a shale combustion subsystem 204, in a side view. As described above, a shale combustion subsystem 204 combusts pyrolyzed shale from the retort 234, and uses heat from the combustion to boil water and superheat the resulting steam. In the depicted embodiment, the shale combustion subsystem 204 includes an upper hopper 904, a combustion chamber 906, a blower 908, a duct 910, a heat exchanger 912, a boiler 914, a cyclonic separator 916, and a lower hopper 918. Superheated steam exits the shale combustion subsystem 204 to the steam temperature control subsystem 236 via steam pipe 902, while gasses from combustion exit the boiler 914 to the filter house 218. Although the side view of FIG. 9 shows one combustion chamber 906, one heat exchanges 912, one boiler 914, and so on, some embodiments of a system 100 may include multiple combustion chambers 906, heat exchangers 912, boilers 914, and so on.

In the depicted embodiment, pyrolyzed shale received from the retort 234 is combusted in one or more combustion chambers 906, and heat from the combustion of the pyrolyzed shale is used in one or more heat exchangers 912 for superheating steam for the steam temperature control subsystem 236. In the depicted embodiment, the steam is produced in one or more boilers 914. In general, in various embodiments, of a shale combustion subsystem 204, combusting or combusted shale and combustion gases may flow in one direction opposite to a counterflow of water and/or steam, to transfer heat from combustion into the water and/or steam.

Shale is conveyed to the upper hopper 904, and moved by augers into the combustion chamber 906. The shale is combusted in the combustion chamber 906, in a flow of air provided by blower 908. In some embodiments, shale may be gas-fluidized by the air from the blower 908, resulting in efficient combustion due to a high surface area for contact between air and finely ground shale. Shale continues to combust as it descends through heat exchanger 912. The heat exchanger 912 is jacketed so that steam flows up along the outside, so that descending and combusting shale and gases in the center of the heat exchanger 912 heats the ascending steam in the jacket. Combustion gases also move down through the heat exchanger 912 due to expansion of the gases in combustion, the pressure maintained by the blower 908, and pressure from the weight of falling shale particles. One or more cyclonic separators 916 are disposed between the heat exchanger(s) 912 and the boiler(s) 914, for removing solid combusted shale particles from the hot combustion gases. In some embodiments, the cyclonic separators 916 include one or more heat exchangers inside the cyclonic separators 916 and/or as a jacket to further transfer heat from the shale and gases to the steam. The combusted shale descends into the lower hopper 918, and may be removed by a conveyor 208. The duct 910 may feed air to the blower 908, and may first direct the air past the shale in the lower hopper 918, to preheat the blower air.

The boiler(s) 914 are configured to heat pressurized water and produce steam at one or more pressure release valves (not shown). Water may be heated under pressure to above the (atmospheric pressure) boiling point, so that it converts to steam at the pressure release valves. Expansion as the water turns to steam or is subsequently heated may drive the steam through the rest of the system 100, including through jackets in the heat exchanger(s) 912 and cyclonic separators 916 where it receives heat from combustion. A pump 210 may provide pressurized water from the feedwater tanks 212 to the boiler(s) 914. Water may be received in the feedwater tanks 212 from the distillation subsystem 240 at or near the boiling point, and the feedwater tanks 212 may be insulated. In some embodiments, water may be held in the feedwater tanks 212 at the boiling point and with additional latent heat added, but not enough heat to boil the water. Supplying such heated water to the boilers 914 may allow efficient boiling to produce steam. Exhaust gas from combustion exits the boiler(s) 914 and is received by filter house(s) 218, which are described below.

Figure 10:
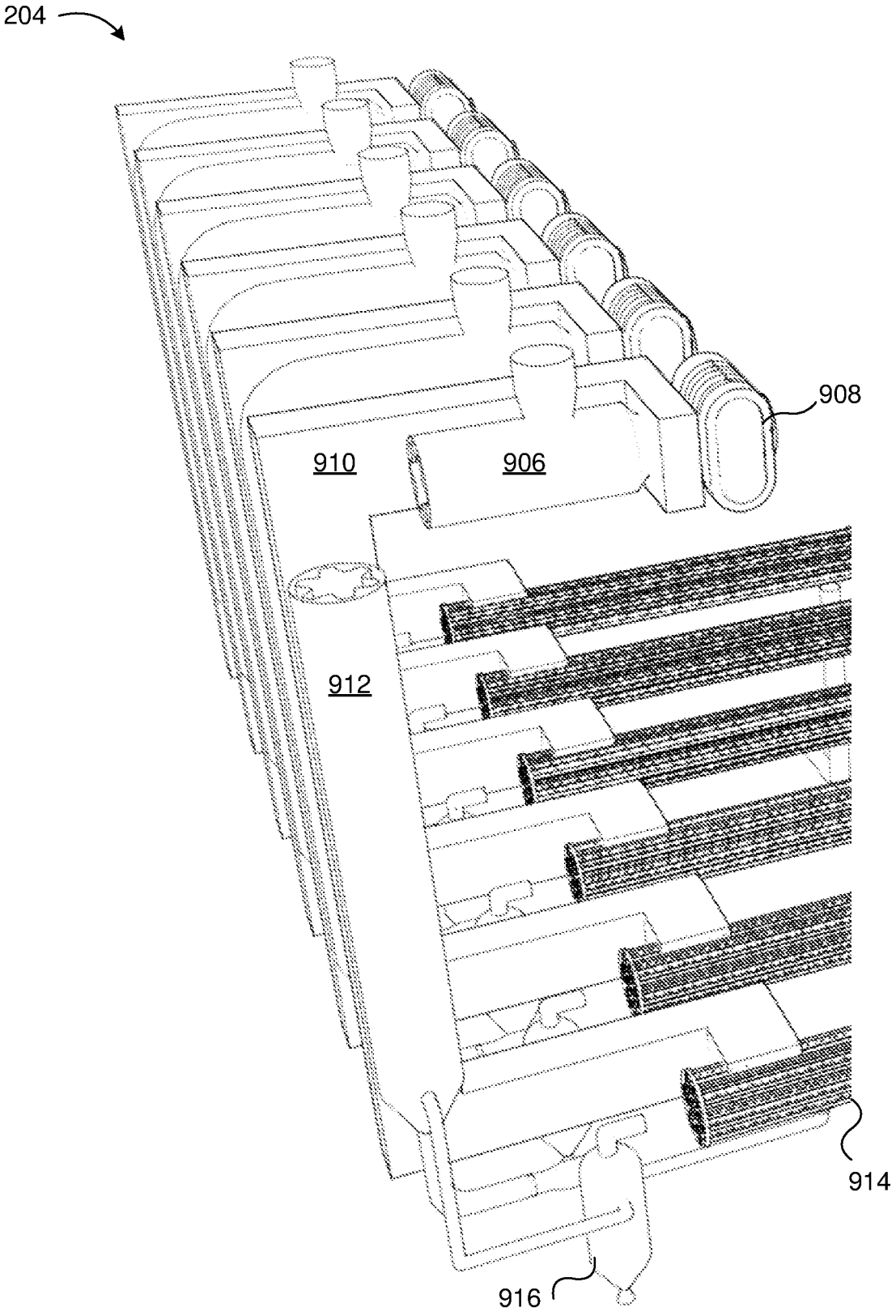
FIG. 10 is a perspective view illustrating embodiments of components of a shale combustion subsystem, according to various embodiments.

FIG. 10 is a perspective view illustrating embodiments of certain components of a shale combustion subsystem 204, as described above. The boiler 914 is depicted without its outer casing, and a section is not depicted between a combustion chamber 906 and a heat exchanger 912, to better illustrate internal components of the shale combustion subsystem 204. In the depicted embodiment, the heat exchangers 912 for superheating steam include vertical compartments for ascending steam to be heated by descending shale particles and combustion gases. In the depicted embodiment, the vertical compartments for ascending steam surround an inner compartment for descending shale particles and combustion gases. In the depicted embodiment, the boilers 914 include horizontal compartments for water (traveling right to left in FIG. 10) to be heated by gases (traveling left to right in FIG. 10) from which solids have been removed (e.g., by cyclonic separators 916).

Figure 11:
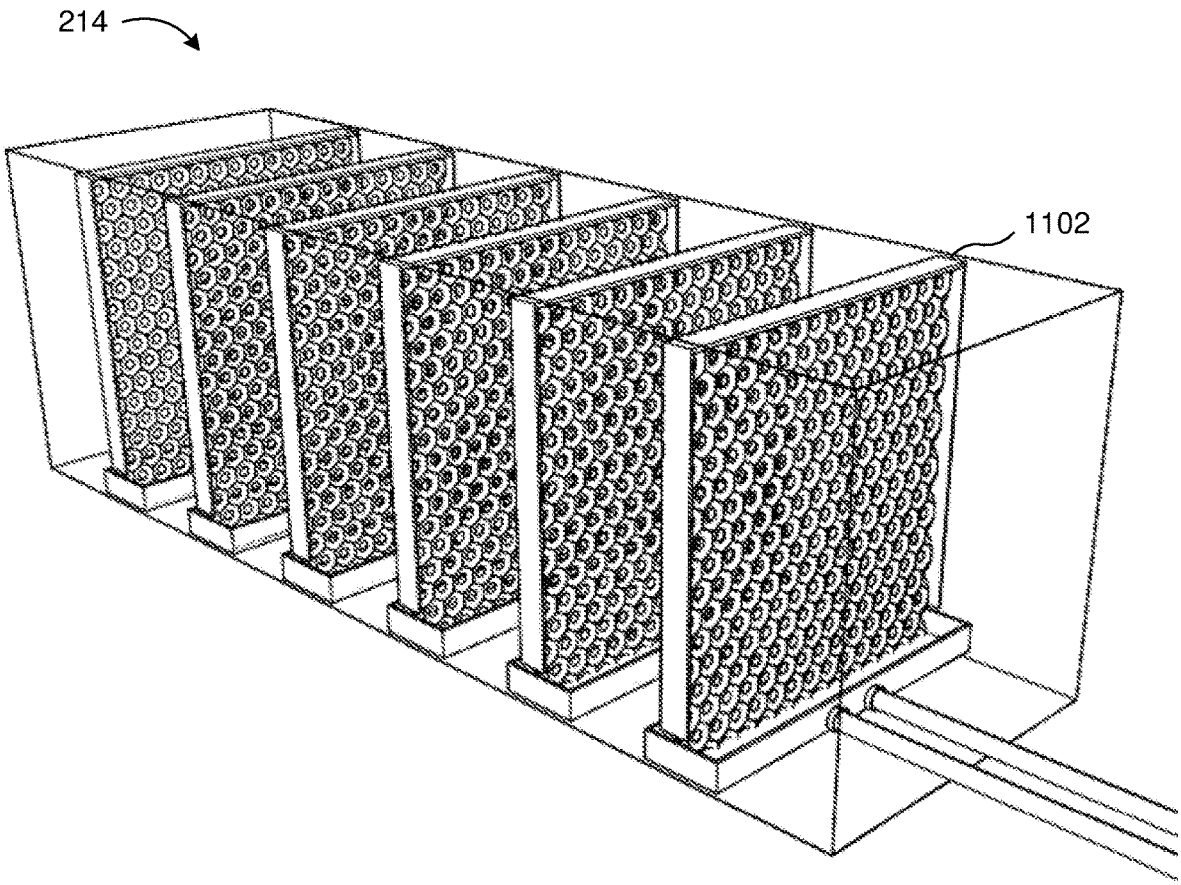
FIG. 11 is a perspective view illustrating a filter house, according to various embodiments.

FIG. 11 is a perspective view illustrating one embodiment of a filter house 218, as described above. Outer walls of the filter house 218 are not depicted, so as to better display internal components. In various embodiments, a filter house 218 may include a plurality of iron-zinc filters 1102. Combustion gases flow horizontally through holes in the filters 1102, and a vertical flow of water is provided (e.g., over the surface of the filters 1102, as drops descending between filters 1102, or the like). The iron-zinc filters 1102 remove hydrogen sulfide from a horizontal flow of combustion gases. The vertical flow of water cools the gases and removes carbon dioxide, so the carbon dioxide from the carbon gases becomes dissolved in the water. The resulting carbon enriched water may be provided to one or more algae ponds 220 for production of algae oil.

Figure 12A:
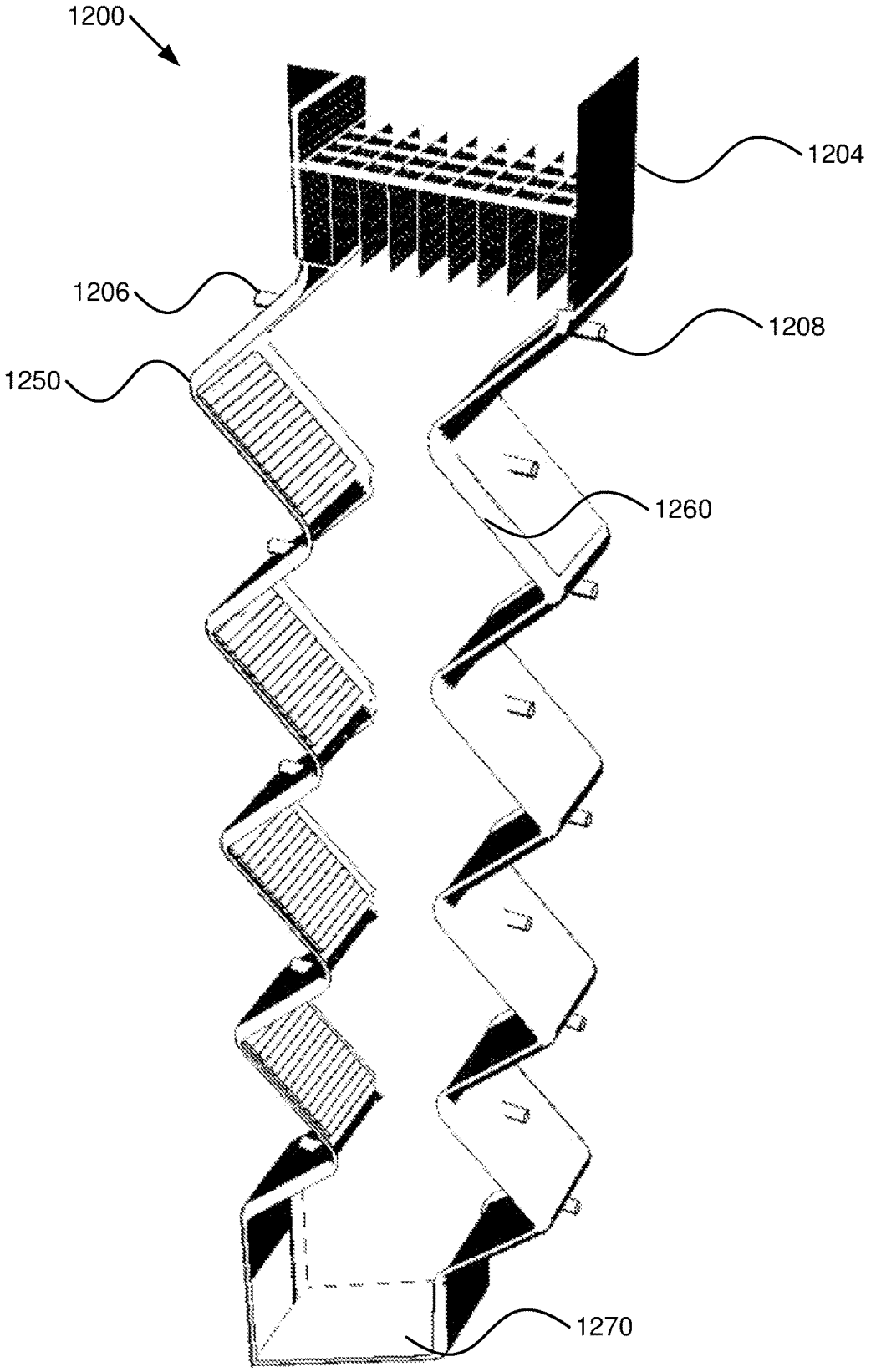
FIG. 12A is a partial perspective view of a retort of a shale pyrolysis system depicting rounded corners, according to various embodiments.
Figure 12B:
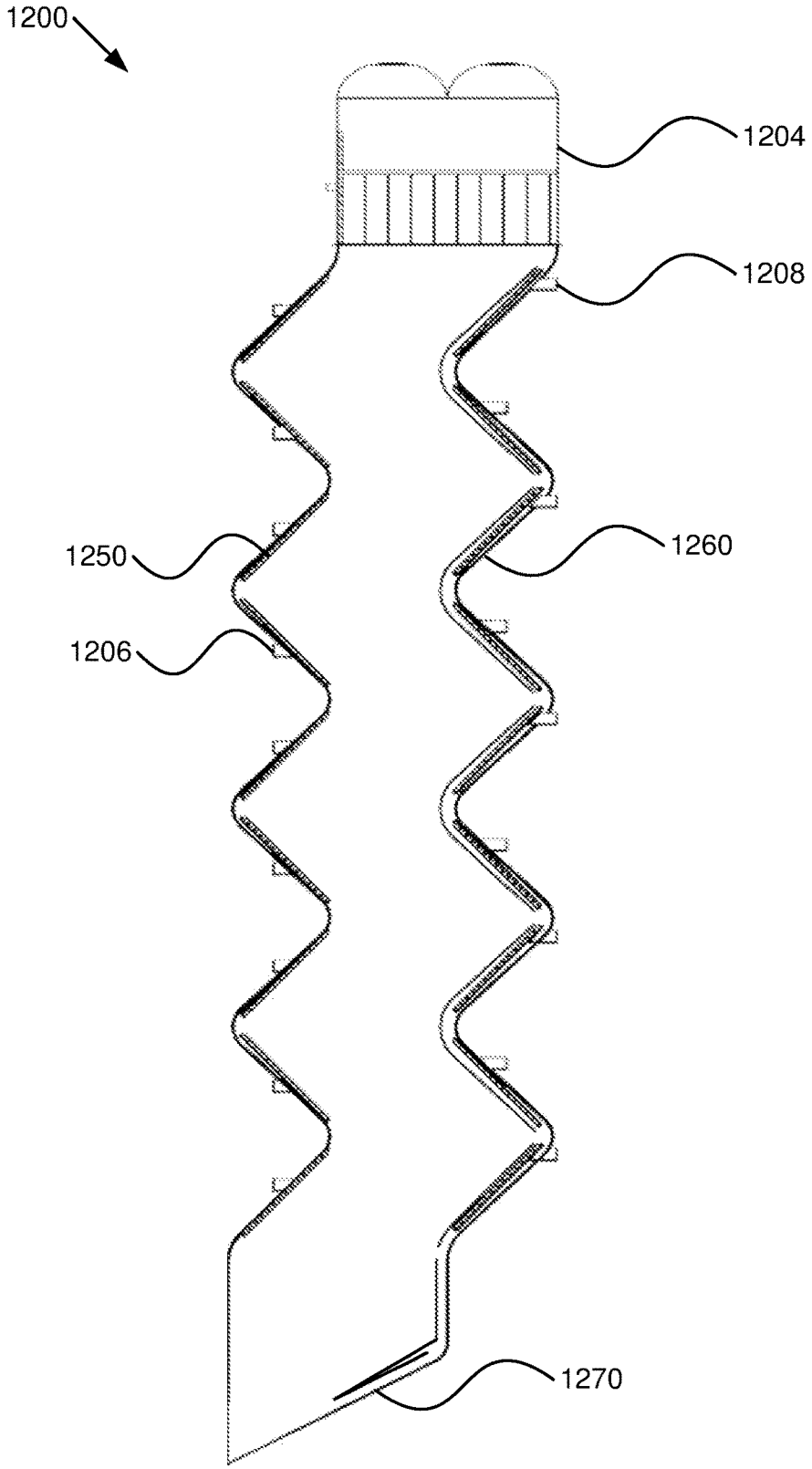
FIG. 12B is a partial side view of the retort of FIG. 12A, according to various embodiments.
Figure 12C:
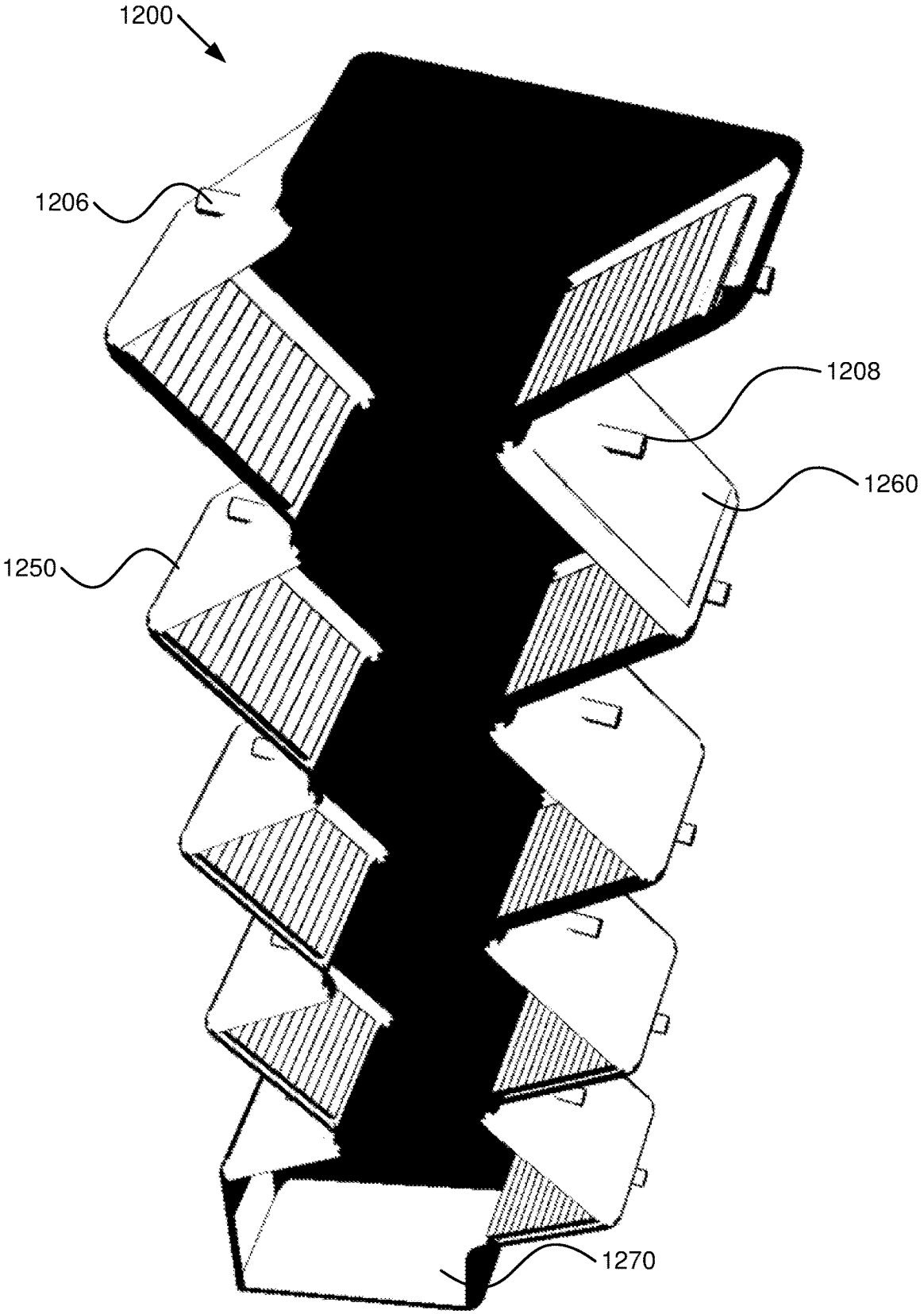
FIG. 12C is another partial perspective view of the retort of FIG. 12A, according to various embodiments.
Figure 12D:
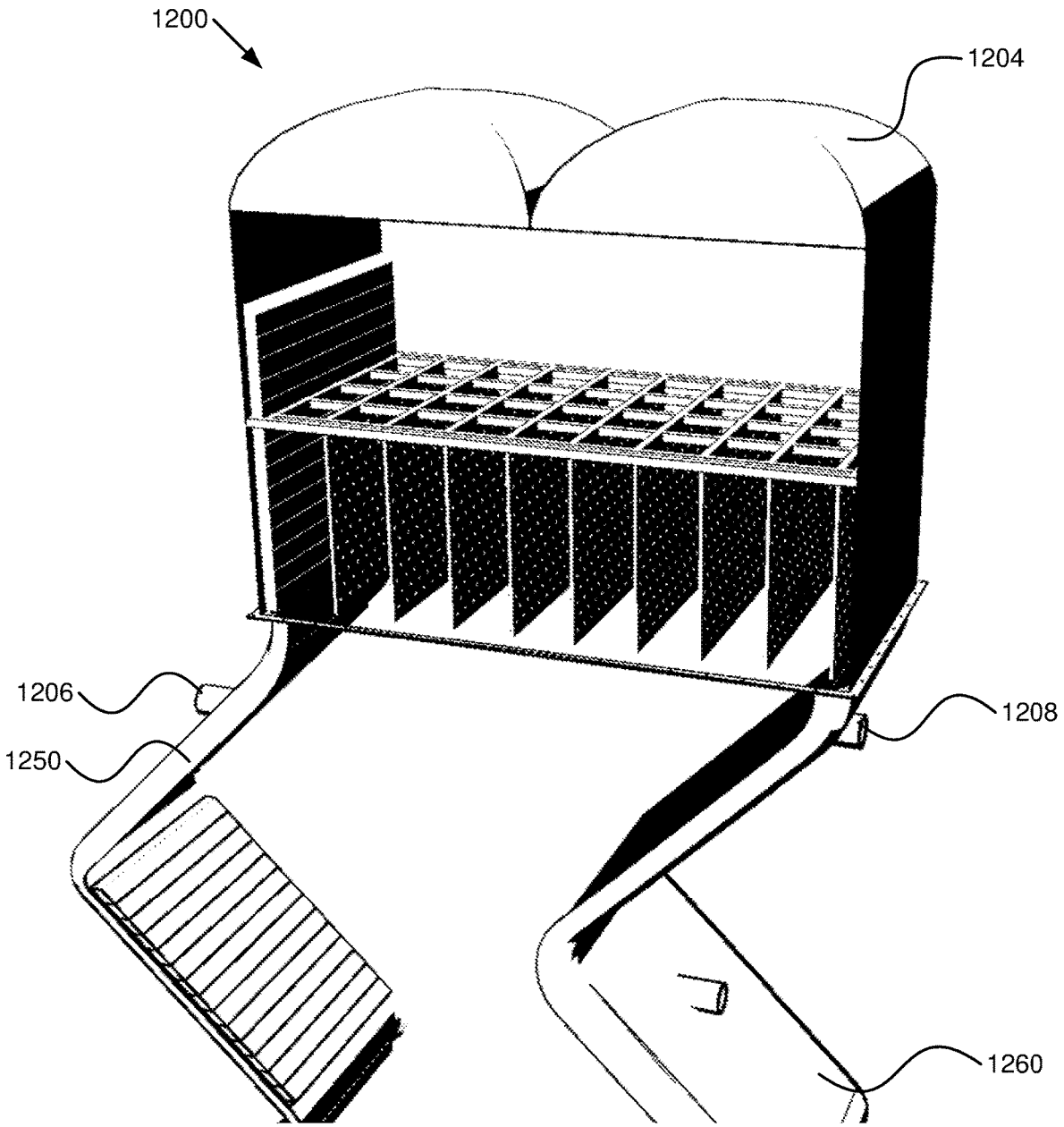
FIG. 12D is a partial perspective view of a top portion of the retort of FIG. 12A illustrating a preheat section, according to various embodiments.
Figure 12E:
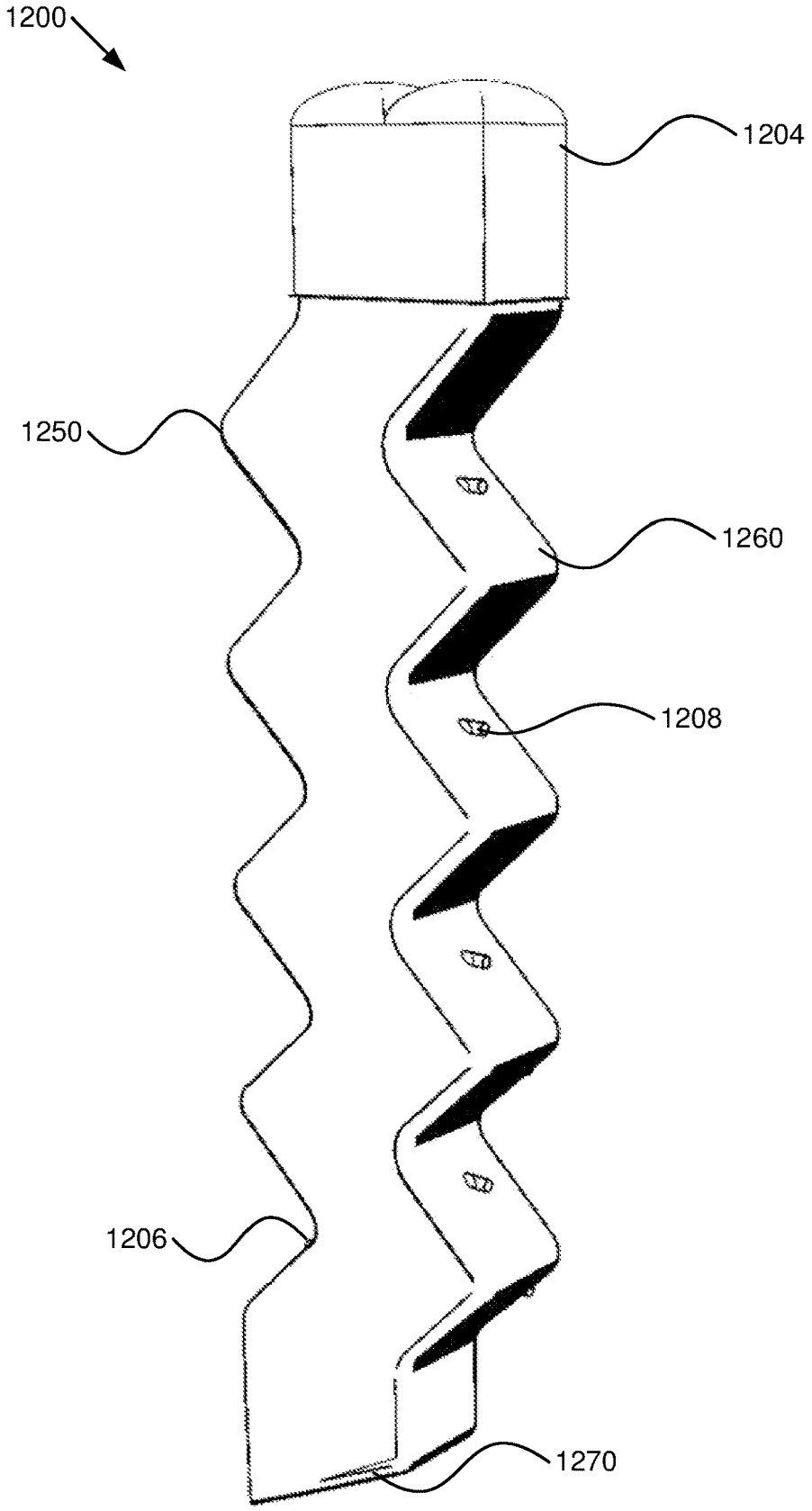
FIG. 12E is a perspective view of the retort of FIG. 12A including sides of the retort, according to various embodiments.
Figure 13:
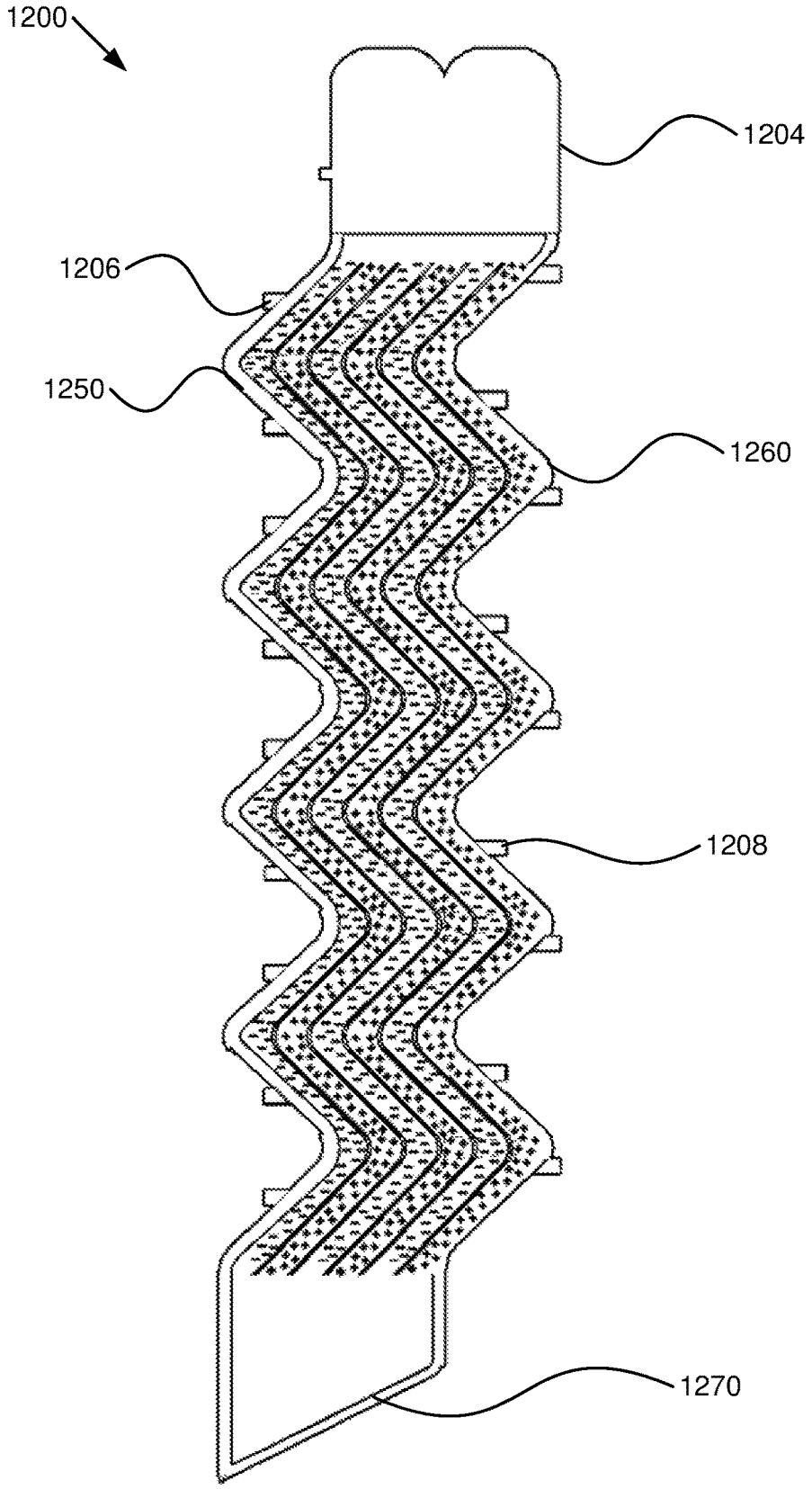
FIG. 13 is a partial side view of a top portion of the retort of FIG. 12A illustrating shale in the retort remaining in lanes, according to various embodiments.

FIG. 12A is a partial perspective view of a retort 1200 of a shale pyrolysis system depicting rounded corners, according to various embodiments. FIG. 12B is a partial side view of the retort 1200 of FIG. 12A. FIG. 12C is another partial perspective view of the retort 1200 of FIG. 12A. FIG. 12D is a partial perspective view of a top portion of the retort 1200 of FIG. 12A illustrating a preheat section 1204, according to various embodiments. FIG. 12E is a perspective view of the retort 1200 of FIG. 12A including sides of the retort 1200, according to various embodiments. The retort 1200 is similar to the retort 234 but illustrates rounded corners.

In addition, the retort 1200 of FIGS. 12A-E has a width and section height ratio such that sections do not overlap creating a center vertical portion that is open from the top to the bottom of the retort 1200. FIG. 13 is a partial side view of a top portion of the retort 1200 of FIG. 12A illustrating shale in the retort remaining in lanes, according to various embodiments. Shale particles are jagged, irregular and have a high amount of friction against each other, which in conjunction with the zig-zag design and rounded corners, prevents shale particles in the center section from moving downward. Instead, modeling has shown that the particles essentially move as depicted in FIG. 13. Thus, shale particles on a left side, for example, stay on the left side. Shale particles in a center section stay together in a "lane" moving back and forth with the shape of the retort 1200 as the shale particles descend. Shale particles on the right side descend while staying on the right side. Note that the lanes depicted in FIG. 13 are merely illustrative of the concept of how the shale particles move and are used for convenience in illustrating the concept of shale movement and are not actual lanes.

The retort 1200 depicts rounded corner, which in some embodiments, are present in the retort 234 described above, but are left out of FIGS. 1, 2B, 4, and 6 for convenience. The rounded corners facilitate movement of the shale particles as depicted in FIG. 13. The radius of the corners is chosen to facilitate movement of the shale particles in lanes. The radius is chosen based on size of the shale particles. In some embodiments, the radius is in the range of 1.5 feet to 5 feet (0.46 meters ("m") to 1.52 m) for 4 inch (10.6 cm) minus shale particles. Smaller shale particles, in some embodiments, move in lanes with rounded corners of smaller radii and larger shale particles move in lanes with rounded corners with larger radii. In some embodiments, the radius is 3 feet (0.91 m) and a width of the retort 1200 of 20 feet (3.66 m). In other embodiments, retorts of other dimensions are used. The dimensions of the retort 1200 and radius of the corners are scalable based on the size of the shale particles. Smaller shale particles stay in lanes with rounded corners with a smaller radius and larger shale particles stay in lanes with rounded corners that have a larger radius. Likewise, the width and section height of the retort 1200 are scalable.

In the retorts 1200, 234 depicted herein, vapor, liquid, and aerosols move from the first side 1250 to the second side 1260, which is left to right in FIGS. 12A-E and 13. Vapors move from left to right due to an outlet, e.g., the collectors 1208, being horizontally across from the distributors 1206. Liquids move from left to right because when the shale particles are moving in sections of the retort 1200 positioned right to left, liquid on a shale particle that drips to another particle or is transferred by touching another particle by gravity, the angle of the lanes are such that the liquid moves from left to right. Note that shale particles in lanes to the left are hotter than shale particles in lanes to the right and temperature decreases from left to right. In sections of the retort 1200 that are positioned left to right, when liquids drip or move by contact to the left, the shale particles are hotter, which promotes vaporization, and when the liquid vaporizes the resulting vapors move from left to right. Aerosols move left to right by vapors moving left to right.

Note that the collectors 408, 1208 in each section are set up to collect vapors/gases at different temperatures, which tends to separate vapors into different types, such as hydrogen, methane, ethane, butane, and other hydrocarbons with high molecular weight that boil at high temperatures. Typically, each hydrocarbon has a different boiling point. The hydrocarbons with the lowest boiling points enter the collectors 408 at the top of the retort 234, 1200, hydrocarbons with medium boiling points leave in sections lower than the top sections of the retort 234, 1200, and hydrocarbons with even higher boiling points leave the retort 234/1200 in collectors 408 at even lower sections of the retort 234, 1200. Some kerogen bursts near the bottom of the retort 234/1200 and gases exit in the lower collectors 408, but are separated in the distillation subsystem 240.

Some hydrocarbons in a gas/vapor form with a lower boiling point leave at a collector 408 intended for hydrocarbons with a higher boiling point. The distillation subsystem 240 includes a plurality of liquid/gas separation vessels 804*a-e* that receive gases from the retort 234. The liquid/gas separation vessels 804*a-e* are coupled in a chain, so that gases exiting earlier separation vessels in the chain are received by later separation vessels in the chain. Chaining together of separation vessels 804*a-e* allows lighter hydrocarbons that are not condensed with the heavier oil fractions to transfer to subsequent separation vessels to be potentially condensed with lighter oil fractions.

A bottom section 1270 of the retort 1200 differs from the bottom section of the retort 234 of FIGS. 2B and 4 and includes a sloped section. The sloped section, in some embodiments, allows pyrolyzed shale to slide out to a horizontal conveyor 242. In other embodiments, the sloped bottom section 1270 includes a conveyor, an auger, or the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gas separating system comprising:

a plurality of separation vessels each receiving gases and liquids exiting from a different level of a vertical retort configured for hydrocarbon extraction from shale, wherein gases and liquids of different levels of the vertical retort exit the vertical retort at different temperatures so that each of the separation vessels receives gases and/or liquids at a different temperature than other of the plurality of separation vessels;

connecting piping fluidly connecting each of the plurality of separation vessels in series from a highest temperature separation vessel to a lowest temperature separation vessel, such that a gas outlet of a higher temperature separation vessel is connected via the connecting piping to an inlet of a lower temperature separation vessel of the plurality of separation vessels; and one or more heat exchangers in each of the plurality of separation vessels, wherein a circulating fluid of a separation vessel of the plurality of separations vessel circulates at a temperature to condense liquid and gas in the separation vessel, wherein the one or more heat exchangers of each of the plurality of separation vessels operates at a different temperature.

2. The gas separating system of claim 1, wherein the connecting piping between two of the plurality of separation vessels is separate from the connecting piping between two other of the plurality of separation vessels.

3. The gas separating system of claim 1, wherein a last separation vessel is connected to a lowest temperature separation vessel of the plurality of separation vessels and is configured to receive gasses and/or liquids from the lowest temperature separation vessel, wherein the last separation vessel is configured to condense water.

4. The gas separating system of claim 1, the plurality of separation vessels are connected in a connection chain from a highest temperature separation vessel to a lowest temperature separation vessel, wherein an outlet of a first separation vessel of the plurality of separation vessels with a highest temperature is connected via the connecting piping to an inlet of a second separation vessel of the plurality of separation vessels with a temperature lower than the first separation vessel, an outlet of the second separation vessel is connected via the connecting piping to an inlet of a third separation vessel with a temperature lower than the second separation vessel, wherein the connection chain continues to a lowest temperature connecting vessel.

5. The gas separating system of claim 1, wherein the vertical retort comprises a first side and a second side, the second side opposite the first side, the vertical retort divided into two or more sections and oriented vertically, wherein the shale descends continuously through the vertical retort, wherein superheated steam is injected at different levels into the first side and wherein the gases and liquids extracted from the vertical retort are extracted from the second side and wherein each steam inlet to the first side injects steam at a different temperature than other inlets of the first side.

6. The gas separating system of claim 5, wherein each section of the vertical retort is angled opposite a previous section such that the vertical retort has a zig-zag pattern.

7. The gas separating system of claim 1, wherein each separation vessel of the plurality of separation vessels comprises an outlet for removing condensed liquid from the separation vessel.

8. The gas separating system of claim 1, wherein a heat exchanger of the one or more heat exchangers of each of the plurality of separation vessels comprises a liquid circulating through the heat exchanger, wherein the liquid circulating through the heat exchanger of each of the plurality of separation vessels differs from the temperature of the liquid of other heat exchangers of other of the plurality of separation vessels.

9. The gas separating system of claim 8, wherein the liquid circulating in the heat exchangers of the plurality of separation vessels comprises water and heat from the plurality of separation vessels is used to heat the water prior to storage in a feedwater tank, wherein water from the feedwater tank is used to produce superheated steam for use in the vertical retort.

10. The gas separating system of claim 1, wherein each of the plurality of separation vessels comprises a cyclonic separator positioned ahead of an inlet to each of the plurality of separation vessels receiving the gases and liquids from the vertical retort, wherein each of the cyclonic separators is configured to remove solid particulate from the gases and/or liquids exiting the vertical retort.

11. The gas separating system of claim 1, further comprising a plurality of generators, wherein each of the plurality of generators corresponds to a separation vessel of the plurality of separations vessels, wherein:

each generator is coupled to and powered by a heat exchanger of the one or more heat exchangers in a corresponding separation vessel; and each of the plurality of generators comprises a different working fluid configured to produce different condensation temperatures for gases in different separation vessels of the plurality of separation vessels.

12. The gas separating system of claim 11, wherein the plurality of generators are organic Rankine cycle ("ORC") generators.

13. The gas separating system of claim 1, wherein each of the separation vessels are configured for condensing hydrocarbons at different condensation temperatures.

14. A gas separating system comprising:

a plurality of separation vessels, each receiving gases and liquids exiting from a different level of a vertical retort configured for hydrocarbon extraction from shale and configured in a zig-zag pattern, wherein gases and liquids of different levels of the vertical retort exit the vertical retort at different temperatures so that each of the separation vessels receives gases and/or liquids at a different temperature than other of the plurality of separation vessels;

a last separation vessel configured to condense water;

connecting piping fluidly connecting each of the plurality of separation vessels and the last separation vessel in series from a highest temperature separation vessel to a lowest temperature separation vessel and then to the last separating vessel, such that a gas outlet of a higher temperature separation vessel is connected via the connecting piping to an inlet of a lower temperature separation vessel of the plurality of separation vessels and an outlet of the lowest temperature separating vessel is connected via the connecting piping to an inlet of the last separation vessel; and one or more heat exchangers in each of the plurality of separation vessels and the last separation vessel, wherein a circulating fluid of a separation vessel of the plurality of separations vessel and the last separation vessel circulates at a temperature to condense liquid and gas in the separation vessel, wherein the one or more heat exchangers of each of the plurality of separation vessels and the last separation vessel operates at a different temperature.

15. The gas separating system of claim 14, further comprising a plurality of generators, wherein each of the plurality of generators corresponds to a separation vessel of the plurality of separations vessels, wherein:

each generator is coupled to and powered by a heat exchanger of the one or more heat exchangers in a corresponding separation vessel; and the plurality of generators comprise different working fluids to produce different condensation temperatures for gases in different separation vessels of the plurality of separation vessels and the last separation vessel.

16. The gas separating system of claim 14, wherein the vertical retort comprises a first side and a second side, the second side opposite the first side, the vertical retort divided into two or more sections and oriented vertically, wherein the shale descends continuously through the vertical retort.

17. The gas separating system of claim 16, wherein superheated steam is injected at different levels into the first side of the vertical retort and wherein the gases and liquids extracted from the vertical retort are extracted from the second side and wherein each steam inlet to the first side injects steam at a different temperature than other inlets of the first side.

18. The gas separating system of claim 14, wherein each separation vessel of the plurality of separation vessels and the last separation vessel comprises an outlet for removing condensed liquid from the separation vessel.

19. The gas separating system of claim 14, wherein each of the plurality of separation vessels and the last separation vessel comprises a heat exchanger of the one or more heat exchangers comprising a liquid circulating through the heat exchanger, wherein the liquid circulating through the heat exchanger of each of the plurality of separation vessels and the last separation vessel differs from the temperature of the liquid of other heat exchangers of other of the plurality of separation vessels and the last separation vessel.

20. A gas separating system comprising:

a plurality of separation vessels, each receiving gases and liquids exiting from a different level of a vertical retort configured for hydrocarbon extraction from shale and configured in a zig-zag pattern, wherein gases and liquids of different levels of the vertical retort exit the vertical retort at different temperatures so that each of the separation vessels receives gases and/or liquids at a different temperature than other of the plurality of separation vessels;

a last separation vessel configured to condense water;

a first heat exchanger in each of the plurality of separation vessels and in the last separation vessel, each first heat exchanger comprising a liquid circulating through the first heat exchanger, wherein the liquid circulating through the first heat exchanger of each of the plurality of separation vessels and the last separation vessel differs from a temperature of liquid of other heat exchangers of other of the plurality of separation vessels and the last separation vessel;

a second heat exchanger in each of the plurality of separation vessels and in the last separation vessel;

a plurality of generators, wherein each of the plurality of generators corresponds to a separation vessel of the plurality of separations vessels and the last separation vessel, wherein each generator is coupled to and powered by the second heat exchanger in a corresponding separation vessel, and each of the plurality of generators comprises a different working fluid to produce different condensation temperatures for gases in different separation vessels of the plurality of separation vessels and the last separation vessel; and connecting piping fluidly connecting each of the plurality of separation vessels and the last separation vessel in series from a highest temperature separation vessel to a lowest temperature separation vessel and then to the last separating vessel, such that a gas outlet of a higher temperature separation vessel is connected via the connecting piping to an inlet of a lower temperature separation vessel of the plurality of separation vessels and an outlet of a lowest temperature separating vessel of the plurality of separation vessels is connected via the connecting piping to an inlet of the last separation vessel.

* * * * *